US010483077B2

(12) United States Patent
Morton

(10) Patent No.: US 10,483,077 B2
(45) **Date of Patent: *Nov. 19, 2019**

(54) X-RAY SOURCES HAVING REDUCED ELECTRON SCATTERING

(71) Applicant: Rapiscan Systems, Inc., Torrance, CA (US)

(72) Inventor: Edward James Morton, Guildford (GB)

(73) Assignee: Rapiscan Systems, Inc., Torrance, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/132,439

(22) Filed: Apr. 19, 2016

(65) Prior Publication Data

US 2016/0343533 A1 Nov. 24, 2016

Related U.S. Application Data

(63) Continuation-in-part of application No. 14/635,814, filed on Mar. 2, 2015, now abandoned, which is a (Continued)

(30) Foreign Application Priority Data

Apr. 25, 2003 (GB) ..... 0309374.7
Jul. 15, 2008 (GB) ..... 0812864.7

(51) Int. Cl.
*H01J 35/12* (2006.01)
*G21K 1/02* (2006.01)
*H01J 35/08* (2006.01)

(52) U.S. Cl.
CPC ..... *H01J 35/12* (2013.01); *G21K 1/02* (2013.01); *H01J 35/08* (2013.01); (Continued)

(58) Field of Classification Search
CPC ..... H01J 35/14; H01J 35/08; H01J 2235/068; H01J 2235/086; H01J 35/16; H01J 35/30
See application file for complete search history.

(56) References Cited

U.S. PATENT DOCUMENTS 2,101,143 A 12/1937 Laidig
2,333,525 A 11/1943 Cox
(Continued)

FOREIGN PATENT DOCUMENTS

CN 1138743 A 12/1996
CN 1172952 A 2/1998
(Continued)

OTHER PUBLICATIONS

US 5,987,079 A, 11/1999, Scott (withdrawn)
(Continued)

*Primary Examiner* — Hoon K Song
(74) *Attorney, Agent, or Firm* — Novel IP

(57) ABSTRACT

This specification describes an anode for an X-ray tube with multiple channels, where each channel defines an electron aperture through which electrons from a source pass to strike a target and a collimating aperture through which X-rays produced at the target pass out of the anode as a collimated beam. At least a portion of the walls of each channel are lined with an electron absorbing material for absorbing any electrons straying from a predefined trajectory. The electron absorbing material has a low atomic number, high melting point and is stable in vacuum. Graphite may be used as the electron absorbing material.

17 Claims, 13 Drawing Sheets

Related U.S. Application Data continuation of application No. 13/313,854, filed on Dec. 7, 2011, now Pat. No. 9,001,973, which is a continuation of application No. 12/478,757, filed on Jun. 4, 2009, now Pat. No. 8,094,784, which is a continuation-in-part of application No. 12/364,067, filed on Feb. 2, 2009, now abandoned, which is a continuation of application No. 12/033,035, filed on Feb. 19, 2008, now Pat. No. 7,505,563, which is a continuation of application No. 10/554,569, filed as application No. PCT/GB2004/001732 on Apr. 23, 2004, now Pat. No. 7,349,525.

(52) U.S. Cl.
CPC . *H01J 2235/086* (2013.01); *H01J 2235/1204* (2013.01); *H01J 2235/1262* (2013.01); *H01J 2235/166* (2013.01)

(56) References Cited

U.S. PATENT DOCUMENTS 2,842,694 A 7/1958 Hosemann
2,952,790 A 9/1960 Steen
3,138,729 A 6/1964 Henke
3,239,706 A 3/1966 Farrell
3,610,994 A 10/1971 Sheldon
3,768,645 A 10/1973 Conway
3,867,637 A 2/1975 Braun
4,045,672 A 8/1977 Watanabe
4,057,725 A 11/1977 Wagner
4,064,411 A 12/1977 Iwasaki
4,105,922 A 8/1978 Lambert
4,165,472 A 8/1979 Wittry
4,171,254 A 10/1979 Koenecke
4,228,353 A 10/1980 Johnson
4,238,706 A 12/1980 Yoshihara
4,241,404 A 12/1980 Lux
4,259,721 A 3/1981 Kuznia
4,266,425 A 5/1981 Allport
4,274,005 A 6/1981 Yamamura
4,309,637 A 1/1982 Fetter
4,340,816 A 7/1982 Schott
4,344,011 A 8/1982 Hayashi
4,352,021 A 9/1982 Boyd
4,352,196 A 9/1982 Gabbay
4,405,876 A 9/1983 Iversen
4,420,382 A 12/1983 Riedl
4,461,020 A 7/1984 Hubner
4,468,802 A 8/1984 Friedel
4,531,226 A 7/1985 Peschmann
4,622,687 A 11/1986 Whitaker
4,625,324 A 11/1986 Blaskis
4,670,895 A 6/1987 Penato
4,672,649 A 6/1987 Rutt
4,675,890 A 6/1987 Plessis
4,677,651 A 6/1987 Hartl
4,719,645 A 1/1988 Yamabe
4,736,400 A 4/1988 Koller
4,763,345 A 8/1988 Barbaric
RE32,961 E 6/1989 Wagner
4,866,745 A 9/1989 Akai
4,868,856 A 9/1989 Frith
4,887,604 A 12/1989 Shefer
4,894,775 A 1/1990 Kritchman
4,928,296 A 5/1990 Kadambi
4,945,562 A 7/1990 Staub
4,991,194 A 2/1991 Laurent
5,018,181 A 5/1991 Iversen
5,033,106 A 7/1991 Kita
5,056,127 A 10/1991 Iversen
5,065,418 A 11/1991 Bermbach
5,068,882 A 11/1991 Eberhard
5,073,910 A 12/1991 Eberhard
5,091,924 A 2/1992 Bermbach
5,091,927 A 2/1992 Golitzer
5,138,308 A 8/1992 Clerc
5,144,191 A 9/1992 Jones et al.
5,159,234 A 10/1992 Wegmann
5,191,600 A 3/1993 Vincent
5,195,112 A 3/1993 Vincent
5,247,556 A 9/1993 Eckert
5,259,014 A 11/1993 Brettschneider
5,268,955 A 12/1993 Burke
5,272,627 A 12/1993 Maschhoff
5,305,363 A 4/1994 Burke
5,313,511 A 5/1994 Annis
5,329,180 A 7/1994 Popli
5,367,552 A 11/1994 Peschmann
5,375,156 A 12/1994 Kuo-Petravic
5,414,622 A 5/1995 Walters
5,467,377 A 11/1995 Dawson
5,511,104 A 4/1996 Mueller
5,515,414 A 5/1996 dAchardVanEnschut
5,541,975 A 7/1996 Anderson
5,568,829 A 10/1996 Crawford
5,596,621 A 1/1997 Schwarz
5,600,700 A 2/1997 Krug
5,604,778 A 2/1997 Polacin
5,616,926 A 4/1997 Shinada
5,633,907 A 5/1997 Gravelle
5,654,995 A 8/1997 Flohr
5,680,432 A 10/1997 Voss
5,689,541 A 11/1997 Schardt
5,712,889 A 1/1998 Lanzara
5,798,972 A 8/1998 Lao
5,841,831 A 11/1998 Hell
5,859,891 A 1/1999 Hibbard
5,879,807 A 3/1999 Inoue
5,889,833 A 3/1999 Silver
5,907,593 A 5/1999 Hsieh
5,966,422 A 10/1999 Dafni
5,974,111 A 10/1999 Krug
5,987,097 A 11/1999 Salasoo
6,014,419 A 1/2000 Hu
6,018,562 A 1/2000 Willson
6,075,836 A 6/2000 Ning
6,088,426 A 7/2000 Miller
6,108,575 A 8/2000 Besson
6,122,343 A 9/2000 Pidcock
6,130,502 A 10/2000 Kobayashi
6,181,765 B1 1/2001 Sribar
6,183,139 B1 2/2001 Solomon
6,188,747 B1 2/2001 Geus
6,218,943 B1 4/2001 Ellenbogen
6,229,870 B1 5/2001 Morgan
6,236,709 B1 5/2001 Perry
6,240,157 B1 5/2001 Danielsson
6,269,142 B1 7/2001 Smith
6,298,110 B1 10/2001 Ning
6,324,243 B1 11/2001 Edic
6,324,249 B1 11/2001 Fazzio
6,341,154 B1 1/2002 Besson
6,404,230 B1 6/2002 Cairns
6,430,260 B1 8/2002 Snyder
6,449,331 B1 9/2002 Nutt
6,470,065 B1 10/2002 Lauther
6,480,571 B1 11/2002 Andrews
6,546,072 B1 1/2003 Chalmers
6,553,096 B1 4/2003 Zhou
6,556,653 B2 4/2003 Chalmers
6,580,780 B1 6/2003 Miller
6,624,425 B2 9/2003 Nisius
6,674,838 B1 1/2004 Barrett
6,735,271 B1 4/2004 Naidu
6,751,293 B1 6/2004 Barrett
6,760,407 B2 6/2004 Fessler
6,785,359 B2 8/2004 Lemaitre
6,819,742 B1 11/2004 Miller
6,975,703 B2 12/2005 Katcha
6,993,115 B2 1/2006 Georgeson
7,079,624 B1 7/2006 Miller
7,184,520 B1 2/2007 Sano

(56) References Cited

U.S. PATENT DOCUMENTS

| | | | | |
|---|---|---|---|---|
| 7,192,031 | B2 | 3/2007 | Ying | |
| 7,197,116 | B2 | 3/2007 | Dunham | |
| 7,203,269 | B2 | 4/2007 | Huber | |
| 7,203,282 | B2 | 4/2007 | Brauss | |
| 7,218,700 | B2 | 5/2007 | Muenchau | |
| 7,233,644 | B1 | 6/2007 | Bendahan | |
| 7,248,673 | B2 | 7/2007 | Miller | |
| 7,349,525 | B2 * | 3/2008 | Morton | H01J 35/08 378/124 |
| 7,466,799 | B2 | 12/2008 | Miller | |
| 7,508,916 | B2 | 3/2009 | Frontera | |
| 7,664,230 | B2 | 2/2010 | Morton | |
| 7,697,665 | B2 | 4/2010 | Yonezawa | |
| 7,728,397 | B2 | 6/2010 | Gorrell | |
| 7,738,632 | B2 | 6/2010 | Popescu | |
| 8,094,784 | B2 * | 1/2012 | Morton | G21K 1/02 378/124 |
| 8,243,876 | B2 | 8/2012 | Morton | |
| 8,331,535 | B2 | 12/2012 | Morton | |
| 8,654,924 | B2 | 2/2014 | Behling | |
| 2001/0022346 | A1 | 9/2001 | Katagami et al. | |
| 2001/0033635 | A1 | 9/2001 | Katagami | |
| 2002/0031202 | A1 | 3/2002 | Callerame | |
| 2002/0082492 | A1 | 6/2002 | Grzeszczuk | |
| 2002/0094064 | A1 | 7/2002 | Zhou | |
| 2002/0097836 | A1 | 7/2002 | Grodzins | |
| 2002/0176531 | A1 | 7/2002 | McClelland | |
| 2002/0140336 | A1 | 10/2002 | Stoner | |
| 2003/0021377 | A1 * | 1/2003 | Turner | G01N 23/223 378/102 |
| 2003/0031352 | A1 | 1/2003 | Turner | |
| 2003/0043957 | A1 | 3/2003 | Pelc | |
| 2003/0048868 | A1 | 3/2003 | Bailey | |
| 2003/0076921 | A1 | 4/2003 | Mihara | |
| 2003/0076924 | A1 | 4/2003 | Mario | |
| 2003/0091148 | A1 | 5/2003 | Bittner | |
| 2004/0120454 | A1 | 1/2004 | Seppi | |
| 2004/0021623 | A1 | 2/2004 | Nicolas | |
| 2004/0022292 | A1 | 2/2004 | Morton | |
| 2004/0057554 | A1 * | 3/2004 | Bjorkholm | G01V 5/0016 378/143 |
| 2004/0066879 | A1 | 4/2004 | Machida | |
| 2004/0094064 | A1 | 5/2004 | Taguchi | |
| 2004/0213378 | A1 | 6/2004 | Ellenbogen | |
| 2004/0202282 | A1 | 10/2004 | Miller | |
| 2004/0252807 | A1 | 10/2004 | Skatter | |
| 2004/0258305 | A1 | 12/2004 | Burnham | |
| 2005/0002492 | A1 | 1/2005 | Rother | |
| 2005/0031075 | A1 | 2/2005 | Hopkins | |
| 2005/0053189 | A1 | 2/2005 | Gohno | |
| 2005/0058242 | A1 | 3/2005 | Peschmann | |
| 2005/0105682 | A1 | 3/2005 | Heumann | |
| 2005/0100135 | A1 | 5/2005 | Lowman | |
| 2005/0111610 | A1 | 5/2005 | DeMan | |
| 2005/0157925 | A1 | 5/2005 | Lorenz | |
| 2005/0123092 | A1 | 6/2005 | Mistretta | |
| 2005/0175151 | A1 | 8/2005 | Dunham | |
| 2005/0276377 | A1 | 12/2005 | Carol | |
| 2005/0276382 | A1 | 12/2005 | Lesiak | |
| 2006/0050842 | A1 | 3/2006 | Wang | |
| 2006/0233297 | A1 | 10/2006 | Ishiyama | |
| 2007/0053495 | A1 | 1/2007 | Seppi | |
| 2007/0064873 | A1 | 3/2007 | Gabioud | |
| 2007/0172023 | A1 | 7/2007 | Morton | |
| 2007/0183575 | A1 | 8/2007 | Lemaitre | |
| 2007/0297570 | A1 | 12/2007 | Kerpershoek | |
| 2008/0019483 | A1 | 1/2008 | Andrews | |
| 2008/0043920 | A1 | 2/2008 | Liu | |
| 2008/0056436 | A1 | 3/2008 | Pack | |
| 2008/0056437 | A1 | 3/2008 | Pack | |
| 2008/0069420 | A1 | 3/2008 | Zhang | |
| 2008/0112540 | A1 | 5/2008 | Rogers | |
| 2008/0123803 | A1 | 5/2008 | DeMan | |
| 2008/0130974 | A1 | 6/2008 | Xu | |
| 2009/0022264 | A1 | 1/2009 | Zhou | |
| 2009/0086898 | A1 * | 4/2009 | Richardson | G01N 23/223 378/45 |
| 2009/0097836 | A1 | 4/2009 | Tanaka | |
| 2009/0159451 | A1 | 6/2009 | Tomantschger | |
| 2009/0185660 | A1 | 7/2009 | Zou | |
| 2010/0046716 | A1 | 2/2010 | Freudenberger | |
| 2010/0098219 | A1 * | 4/2010 | Vermilyea | G21K 1/025 378/149 |
| 2010/0111265 | A1 | 5/2010 | Holm | |
| 2010/0246754 | A1 | 9/2010 | Morton | |
| 2010/0316192 | A1 | 12/2010 | Hauttmann | |
| 2011/0007876 | A1 | 1/2011 | Morton | |
| 2011/0188725 | A1 | 8/2011 | Yu | |
| 2011/0222662 | A1 | 9/2011 | Behling | |
| 2013/0156161 | A1 | 6/2013 | Andrews | |
| 2013/0195253 | A1 | 8/2013 | Andrews | |

FOREIGN PATENT DOCUMENTS

| | | | |
|---|---|---|---|
| CN | 1194718 | | 9/1998 |
| CN | 1316827 | | 10/2001 |
| CN | 1795527 | A | 6/2006 |
| DE | 2729353 | A1 | 1/1979 |
| DE | 3638378 | | 5/1988 |
| DE | 3840398 | A1 | 6/1989 |
| DE | 4432205 | C1 | 1/1996 |
| DE | 4425691 | A1 | 2/1996 |
| DE | 19745998 | A1 | 3/1999 |
| DE | 10036210 | A1 | 11/2001 |
| DE | 10319547 | | 11/2004 |
| DE | 10319549 | B3 | 12/2004 |
| EP | 0142249 | A2 | 5/1985 |
| EP | 0432568 | | 6/1991 |
| EP | 0531993 | A1 | 3/1993 |
| EP | 0584871 | A1 | 3/1994 |
| EP | 0924742 | A2 | 6/1999 |
| EP | 0930046 | A2 | 7/1999 |
| EP | 1277439 | A1 | 1/2003 |
| EP | 1374776 | A1 | 1/2004 |
| EP | 1558142 | A1 | 8/2005 |
| FR | 2328280 | A1 | 5/1977 |
| FR | 2675629 | A1 | 10/1992 |
| GB | 1149796 | A | 4/1969 |
| GB | 1272498 | A | 4/1972 |
| GB | 1497396 | A | 1/1978 |
| GB | 1526041 | A | 9/1978 |
| GB | 2015245 | A | 9/1979 |
| GB | 2089109 | A | 6/1982 |
| GB | 2212903 | A | 8/1989 |
| GB | 2212975 | A | 8/1989 |
| GB | 2360405 | | 9/2001 |
| GB | 2360405 | A | 9/2001 |
| GB | 2418529 | A | 3/2006 |
| JP | 50081080 | A | 7/1975 |
| JP | S51055286 | | 5/1976 |
| JP | S51078696 | | 7/1976 |
| JP | S52050186 | | 4/1977 |
| JP | S52124890 | | 10/1977 |
| JP | S5493993 | | 7/1979 |
| JP | S55046408 | | 4/1980 |
| JP | 56086448 | | 7/1981 |
| JP | S56167464 | | 12/1981 |
| JP | S5717524 | A | 1/1982 |
| JP | S57110854 | | 7/1982 |
| JP | 570175247 | | 10/1982 |
| JP | S57175247 | A | 10/1982 |
| JP | 58212045 | A | 12/1983 |
| JP | 590016254 | A | 1/1984 |
| JP | S591625 | A | 1/1984 |
| JP | S5916254 | A | 1/1984 |
| JP | 59075549 | | 4/1984 |
| JP | S5975549 | A | 4/1984 |
| JP | 600015546 | | 1/1985 |
| JP | S601554 | A | 1/1985 |
| JP | 600021440 | | 2/1985 |
| JP | S6038957 | A | 2/1985 |
| JP | S60021440 | | 2/1985 |
| JP | S60181851 | | 12/1985 |
| JP | 61107642 | | 5/1986 |

(56) References Cited

FOREIGN PATENT DOCUMENTS

| | | | |
|---|---|---|---|
| JP | 62044940 | A | 2/1987 |
| JP | S62121773 | | 8/1987 |
| JP | 63016535 | | 1/1988 |
| JP | 1296544 | A | 11/1989 |
| JP | 03198975 | | 8/1991 |
| JP | H0479128 | A | 3/1992 |
| JP | H04319237 | | 11/1992 |
| JP | H05135721 | A | 6/1993 |
| JP | H05182617 | A | 7/1993 |
| JP | H05290768 | A | 11/1993 |
| JP | 060038957 | | 2/1994 |
| JP | H0638957 | A | 2/1994 |
| JP | 06162974 | | 6/1994 |
| JP | H06261895 | | 9/1994 |
| JP | H07093525 | | 4/1995 |
| JP | H09171788 | | 6/1997 |
| JP | H10211196 | A | 8/1998 |
| JP | H10272128 | | 10/1998 |
| JP | H11500229 | | 1/1999 |
| JP | H11273597 | | 10/1999 |
| JP | 2000175895 | | 6/2000 |
| JP | 2001023557 | | 1/2001 |
| JP | 2001502473 | | 2/2001 |
| JP | 2001176408 | A | 6/2001 |
| JP | 2001204723 | | 7/2001 |
| JP | 2002343291 | | 11/2002 |
| JP | 2003092076 | | 3/2003 |
| JP | 2003121392 | | 4/2003 |
| JP | 2003126075 | A | 5/2003 |
| JP | 2003257347 | | 9/2003 |
| JP | 2004000605 | A | 1/2004 |
| JP | 2004079128 | A | 3/2004 |
| JP | 2004311245 | | 11/2004 |
| JP | 2004357724 | | 12/2004 |
| JP | 2005013768 | A | 1/2005 |
| JP | 2006128137 | | 5/2006 |
| JP | 2006351272 | A | 12/2006 |
| JP | 2007265981 | | 10/2007 |
| JP | 2008166059 | A | 7/2008 |
| JP | 2010060572 | | 3/2010 |
| JP | 100211196 | | 9/2010 |
| SU | 1022236 | A1 | 6/1983 |
| WO | 9528715 | A2 | 10/1995 |
| WO | 9718462 | A1 | 5/1997 |
| WO | 9960387 | A2 | 11/1999 |
| WO | 2002031857 | | 4/2002 |
| WO | 03051201 | A2 | 6/2003 |
| WO | 2004010127 | | 1/2004 |
| WO | 2004042769 | A1 | 5/2004 |
| WO | 2004097386 | A1 | 11/2004 |
| WO | 2004097888 | A2 | 11/2004 |
| WO | 2004097889 | A2 | 11/2004 |
| WO | 2006130630 | | 12/2006 |
| WO | 2006130630 | A2 | 12/2006 |
| WO | 2007068933 | | 6/2007 |
| WO | 2008068691 | | 6/2008 |
| WO | 2009012453 | | 1/2009 |
| WO | 2009012453 | A1 | 1/2009 |
| WO | 2010007375 | A2 | 1/2010 |
| WO | 2010086653 | | 8/2010 |
| WO | 2010141659 | A1 | 12/2010 |

OTHER PUBLICATIONS

Morton, E.J., 2010, "Position sensitive detectors in security: Users perspective", Invited talk, STFC meeting on position sensitive detectors, RAL, May 2010.

Notice of Allowance dated Apr. 12, 2016 for U.S. Appl. No. 14/739,833.

International Search Report, PCT/GB2004/001729, dated Aug. 12, 2004, Rapiscan Systems, Inc.

International Search Report, PCT/GB2004/001732, dated Feb. 25, 2005.

Notification of Reexamination for Chinese Patent Application No. CN200980144807X, dated Oct. 12, 2015.

Examination Report for GB1120237.1, dated Aug. 13, 2015.

Notice of Allowance dated Mar. 19, 2015 for U.S. Appl. No. 13/146,645.

Office Action dated Nov. 26, 2014 for U.S. Appl. No. 13/146,645.

STMicroelectronics, "Dual Full-Bridge Driver", Datasheet for L298, 2000, pp. 1-13, XP002593095.

International Search Report, PCT/US2010/41871, dated Oct. 4, 2010, Rapiscan Systems, Inc.

Notice of Allowance dated Jan. 30, 2015 for U.S. Appl. No. 13/405,117.

European Search Opinion, Application No. EP10784058, dated Dec. 18, 2013, Publication No. EP2438212.

Supplementary European Search Report, EP10784058, dated Dec. 6, 2013.

Communication Pursuant to Article 94(3) EPC for EP10784058, dated Aug. 21, 2015.

Extended European Search Report for EP15174771, CXR Limited, dared Sep. 28, 2015.

Bruder et al. "Efficient Extended Field of View (eFOV) Reconstructuion Techniques for Multi-Slice Helical CT", Medical Imaging 2008: Physics of Medical Imaging, edited by Jiang Hsieh, Ehsan Samei, Proc. of SPIE vol. 6913, 69132E, (2008).

Chinese Patent Application No. 200980114807.X, Second Office Action, dated Nov. 21, 2013.

Great Britain Patent Application No. GB0816823.9, Search Report, dated Oct. 20, 2009.

Great Britain Patent Application No. GB1104148.0, Examination Report, dated Mar. 29, 2011.

International Search Report, PCT/GB2004/001731, dated May 27, 2005.

International Search Report, PCT/GB2004/001741, dated Mar. 3, 2005.

International Search Report, PCT/GB2004/001747, dated Aug. 10, 2004.

International Search Report, PCT/GB2004/001751, dated Mar. 21, 2005.

International Search Report, PCT/GB2009/001760, dated Mar. 1, 2010, Rapiscan Systems, Inc.

International Search Report for PCT/US2010/037167, dated Sep. 7, 2010.

Notice of Allowance dated Dec. 4, 2014 for U.S. Appl. No. 13/313,854.

Office Action dated Apr. 17, 2015 for U.S. Appl. No. 13/054,066.

Office Action dated Jan. 3, 2014 for U.S. Appl. No. 13/054,066.

Office Action dated Oct. 21, 2014 for U.S. Appl. No. 13/674,086.

Office Action dated Oct. 30, 2014 for U.S. Appl. No. 13/054,066.

Second office action for Japanese Application No. JP2012-514109 dated Oct. 20, 2014.

Notice of Allowance dated Oct. 6, 2015 for U.S. Appl. No. 13/054,666.

Notice of Allowance dated Aug. 3, 2015 for U.S. Appl. No. 13/674,086.

Office Action dated Mar. 17, 2015 for U.S. Appl. No. 13/674,086.

International Search Report, PCT/US2010/37167, dated Dec. 9, 2010.

International Search Report, PCT/US2012/40923, dated Sep. 21, 2012, Rapiscan Systems, Inc.

Office Action for Japanese Patent Application No. 2015-515989, dated Nov. 19, 2015.

Examination Report for for EP15174771, CXR Limited, dated Apr. 5, 2017.

Dijon et al. "Towards a low-cost high-quality carbon-nanotube field-emission display", Revised version of a paper presented at the 2004 SID International Symposium held May 25-27, 2004 in Seattle, Washington, Journal of the SID Dec. 4, 2004, pp. 373-378.

Office Action dated Dec. 14, 2015 for U.S. Appl. No. 14/739,833.

European Search Report for EP 15174778, CXR Limited, completed on Sep. 18, 2015.

European Search Report for EP 15174778, CXR Limited, dated Oct. 15, 2015.

(56) References Cited

OTHER PUBLICATIONS

Keevil, S.V., Lawinski, C.P. and Morton, E.J., 1987, "Measurement of the performance characteristics of anti-scatter grids.", Phys. Med. Biol., 32(3), 397-403.
Morton, E.J., Webb, S., Bateman, J.E., Clarke, L.J. and Shelton, C.G., 1990, "Three-dimensional x-ray micro-tomography for medical and biological applications.", Phys. Med. Biol., 35(7), 805-820.
Morton, E.J., Swindell, W, Lewis, D.G. and Evans, P.M., 1991, "A linear array scintillation-crystal photodiode detector for megavoltage imaging.", Med. Phys., 18(4), 681-691.
Morton, E.J., Lewis, D.G. and Swindell, W., 1988, "A method for the assessment of radiotherapy treatment precision", Brit. J. Radiol., Supplement 22, 25.
Swindell, W., Morton, E.J., Evans, P.M. and Lewis, D.G., 1991, "The design of megavoltage projection imaging systems: some theoretical aspects.", Med. Phys.,18(5), 855-866.
Morton, E.J., Evans, P.M., Ferraro, M., Young, E.F. and Swindell, W., 1991, "A video frame store facility for an external beam radiotherapy treatment simulator.", Brit. J. Radiol., 64, 747-750.
Antonuk, L.E., Yorkston, J., Kim, C.W., Huang, W., Morton, E.J., Longo, M.J. and Street, R.A., 1991, "Light response characteristics of amorphous silicon arrays for megavoltage and diagnostic imaging.", Mat. Res. Soc. Sym. Proc., 219, 531-536.
Yorkston, J., Antonuk, L.E., Morton, E.J., Boudry, J., Huang, W., Kim, C.W., Longo, M.J. and Street, R.A., 1991, "The dynamic response of hydrogenated amorphous silicon imaging pixels.", Mat. Res. Soc. Sym. Proc., 219, 173-178.
Evans, P.M., Gildersleve, J.Q., Morton, E.J., Swindell, W., Coles, R., Ferraro, M., Rawlings, C., Xiao, Z.R. and Dyer, J., 1992, "Image comparison techniques for use with megavoltage imaging systems.", Brit. J. Radiol., 65, 701-709.
Morton, E.J., Webb, S., Bateman, J.E., Clarke, L.J. and Shelton, C.G., 1989, "The development of 3D x-ray micro-tomography at sub 100Ã?Âµresoresolution with medical, industrial and biological applications.", Presentation at IEE colloquium "Medical scanning and imaging techniques of value in non-destructive testing", London, Nov. 3, 1989.
Antonuk, L.E., Boudry, J., Huang, W., McShan, D.L., Morton, E.J., Yorkston, J, Longo, M.J. and Street, R.A., 1992, "Demonstration of megavoltage and diagnostic x-ray imaging with hydrogenated amorphous silicon arrays.", Med. Phys., 19(6), 1455-1466.
Gildersleve, J.Q., Swindell, W., Evans, P.M., Morton, E.J., Rawlings, C. and Dearnaley, D.P., 1991, "Verification of patient positioning during radiotherapy using an integrated megavoltage imaging system.", in "Tumour Response Monitoring and Treatment Planning", Proceedings of the International Symposium of the W. Vaillant Foundation on Advanced Radiation Therapy, Munich, Germany, Ed A. Breit (Berlin: Springer), 693-695.
Lewis, D.G., Evans, P.M., Morton, E.J., Swindell, W. and Xiao, X.R., 1992, "A megavoltage CT scanner for radiotherapy verification.", Phys. Med. Biol., 37, 1985-1999.
Antonuk, L.E., Boudry, J., Kim, C.W., Longo, M.J., Morton, E.J., Yorkston, J. and Street, R.A., 1991, "Signal, noise and readout considerations in the development of amorphous silicon photodiode arrays for radiotherapy and diagnostic x-ray imaging.", SPIE vol. 1443 Medical Imaging V: Image Physics, 108-119.
Antonuk, L.E., Yorkston, J., Huang, W., Boudry, J., Morton, E.J., Longo, M.J. and Street, R.A., 1992, "Radiation response characteristics of amorphous silicon arrays for megavoltage radiotherapy imaging.", IEEE Trans. Nucl. Sci., 39,1069-1073.
Antonuk, L.E., Yorkston, J., Huang, W., Boudry, J., Morton, E.J., Longo, M.J. and Street, R.A., 1992, "Factors affecting image quality for megavoltage and diagnostic x-ray a-Si:H imaging arrays.", Mat. Res. Soc. Sym. Proc., 258, 1069-1074.
Antonuk, L.E., Boudry, J., Yorkston, J., Morton, E.J., Huang, W. and Street, R.A., 1992, "Development of thin-film, flat-panel arrays for diagnostic and radiotherapy imaging.", SPIE vol. 1651, Medical Imaging VI: Instrumentation, 94-105.
Yorkston, J., Antonuk, L.E., Seraji, N., Boudry, J., Huang, W., Morton, E.J., and Street, R.A., 1992, "Comparison of commputer simulations with measurements from a-Si:H imaging arrays.", Mat. Res. Soc. Sym. Proc., 258, 1163-1168.
Morton, E.J., Antonuk, L.E., Berry, J.E., Boudry, J., Huang, W., Mody, P., Yorkston, J. and Longo, M.J., 1992, "A CAMAC based data acquisition system for flat-panel image array readout", Presentation at IEEE Nuclear Science Symposium, Orlando, Oct. 25-31, 1992.
Antonuk, L.E., Yorkston, J., Huang, W., Boudry, J., Morton, E.J. and Street, R.A., 1993, "Large area, flat-panel a-Si:H arrays for x-ray imaging.", SPIE vol. 1896, Medical Imaging 1993: Physics of Medical Imaging, 18-29.
Morton, E.J., Antonuk, L.E., Berry, J.E., Huang, W., Mody, P. and Yorkston, J., 1994, "A data acquisition system for flat-panel imaging arrays", IEEE Trans. Nucl. Sci., 41(4), 1150-1154.
Antonuk, L.E., Boudry, J., Huang, W., Lam, K.L., Morton, E.J., TenHaken, R.K., Yorkston, J. and Clinthorne, N.H., 1994, "Thin-film, flat-panel, composite imagers for projection and tomographic imaging", IEEE Trans. Med. Im., 13(3), 482-490.
Gildersleve, J., Dearnaley, D., Evans, P., Morton, E.J. and Swindell, W., 1994, "Preliminary clinical performance of a scanning detector for rapid portal imaging", Clin. Oncol., 6, 245-250.
Hess, R., De Antonis, P., Morton, E.J. and Gilboy, W.B., 1994, "Analysis of the pulse shapes obtained from single crystal CdZnTe radiation detectors", Nucl. Inst. Meth., A353, 76-79.
DeAntonis, P., Morton, E.J., T. Menezes, 1996, "Measuring the bulk resistivity of CdZnTe single crystal detectors using a contactless alternating electric field method", Nucl. Inst. Meth., A380, 157-159.
DeAntonis, P., Morton, E.J., Podd, F., 1996, "Infra-red microscopy of CdZnTe radiation detectors revealing their internal electric field structure under bias", IEEE Trans. Nucl. Sci., 43(3), 1487-1490.
Tavora, L.M.N., Morgado, R.E., Estep, R.J., Rawool-Sullivan, M., Gilboy, W.B. and Morton, E.J., 1998, "One-sided imaging of large, dense, objects using the 511 keV photons from induced pair production", IEEE Trans. Nucl. Sci., 45(3), 970-975.
Morton, E.J., 1995, "Archaeological potential of computerised tomography", Presentation at IEE Colloquium on "NDT in archaeology and art", London, May 25, 1995.
Tavora, L.M.N. and Morton, E.J., 1998, "Photon production using a low energy electron expansion of the EGS4 code system", Nucl. Inst. Meth., B143, 253-271.
Patel, D.C. and Morton, E.J., 1998, "Analysis of improved adiabatic pseudo- domino logic family", Electron. Lett., 34(19), 1829-1830.
Kundu, A and Morton, E.J., 1999, "Numerical simulation of argon-methane gas filled proportional counters", Nucl. Inst. Meth., A422, 286-290.
Luggar, R.D., Key, M.J., Morton, E.J. and Gilboy, W.B., 1999, "Energy dispersive X-ray scatter for measurement of oil/water ratios", Nucl. Inst. Meth., A422, 938-941.
Morton, E.J., Crockett, G.M., Sellin, P.J. and DeAntonis, P., 1999, "The charged particle response of CdZnTe radiation detectors", Nucl. Inst. Meth., A422, 169-172.
Morton, E.J., Clark, R.J. and Crowley, C., 1999, "Factors affecting the spectral resolution of scintillation detectors", Nucl. Inst. Meth., A422, 155-158.
Morton, E.J., Caunt, J.C., Schoop, K., Swinhoe, M., 1996, "A new handheld nuclear material analyser for safeguards purposes", Presentation at INMM annual meeting, Naples, Florida, Jul. 1996.
Hepworth, S., McJury, M., Oldham, M., Morton, E.J. and Doran, S.J., 1999, "Dose mapping of inhomogeneities positioned in radiosensitive polymer gels", Nucl. Inst. Meth., A422, 756-760.
Morton, E.J., Luggar, R.D., Key, M.J., Kundu, A., Tavora, L.M.N. and Gilboy, W.B., 1999, "Development of a high speed X-ray tomography system for multiphase flow imaging", IEEE Trans. Nucl. Sci., 46 III(1), 380-384.
Tavora, L.M.N., Morton, E.J., Santos, F.P. and Dias, T.H.V.T., 2000, "Simulation of X-ray tubes for imaging applications", IEEE Trans. Nucl. Sci., 47, 1493-1497.
TÃ?Â ¡vora, L.M.N., Morton, E.J. and Gilboy, W.B., 2000, "Design considerations for transmission X-ray tubes operated at diagnostic energies", J. Phys. D: Applied Physics, 33(19), 2497-2507.
Morton, E.J., Hossain, M.A., DeAntonis, P. and Ede, A.M.D., 2001, "Investigation of Au—CdZnTe contacts using photovoltaic measurements", Nucl. Inst. Meth., A458, 558-562.

(56) References Cited

OTHER PUBLICATIONS

Ede, A.M.D., Morton, E.J. and DeAntonis, P., 2001, "Thin-film CdTe for imaging detector applications", Nucl. Inst. Meth., A458, 7-11.
TÃ?Â ¡ vora, L.M.N., Morton, E.J. and Gilboy, W.B., 2001, "Enhancing the ratio of fluorescence to bremsstrahlung radiation in X-ray tube spectra", App. Rad. and Isotopes, 54(1), 59-72.
Menezes, T. and Morton, E.J., 2001, "A preamplifier with digital output for semiconductor detectors", Nucl. Inst. Meth. A., A459, 303-318.
Johnson, D.R., Kyriou, J., Morton, E.J., Clifton, A.C. Fitzgerald, M. and MacSweeney, J.E., 2001, "Radiation protection in interventional radiology", Clin. Rad., 56(2), 99-106.
Tavora, L.M.N., Gilboy, W.B. and Morton, E.J., 2001, "Monte Carlo studies of a novel X-ray tube anode design", Rad. Phys. and Chem., 61, 527-529.
"Morton, E.J., 1998, "Is film dead: the flat plate revolution", Keynote Talk, IPEM Annual Conference, Brighton, Sep. 14-17, 1998"\.
Luggar, R.D., Morton, E.J., Jenneson, P.M. and Key, M.J., 2001, "X-ray tomographic imaging in industrial process control", Rad. Phys. Chem., 61, 785-787.
Luggar, R.D., Morton, E.J., Key, M.J., Jenneson, P.M. and Gilboy, W.B., 1999, "An electronically gated multi-emitter X-ray source for high speed tomography", Presentation at SPIE Annual Meeting, Denver, Jul. 19-23, 1999.
Gregory, P.J., Hutchinson, D.J., Read, D.B., Jenneson, P.M., Gilboy, W.B. and Morton, E.J., 2001, "Non-invasive imaging of roots with high resolution X-ray microtomography", Plant and Soil, 255(1), 351-359.
Kundu, A., Morton, E.J., Key, M.J. and Luggar, R.D., 1999, "Monte Carlo simulations of microgap gas-filled proportional counters", Presentation at SPIE Annual Meeting, Denver, Jul. 19-23, 1999.
Hossain, M.A., Morton, E.J., and Ozsan, M.E., 2002, "Photoelectronic investigation of CdZnTe spectral detectors", IEEE Trans. Nucl. Sci, 49(4), 1960-1964.
Panman, A., Morton, E.J., Kundu, A and Sellin, P.J., 1999, "Optical Monte Carlo transport in scintillators", Presentation at SPIE Annual Meeting, Denver, Jul. 19-23, 1999.
Jenneson, P.M., Gilboy, W.B., Morton, E.J., and Gregory, P.J., 2003, "An X-ray micro-tomography system optimised for low dose study of living organisms", App. Rad. Isotopes, 58, 177-181.
Key, M.J., Morton, E.J., Luggar, R.D. and Kundu, A., 2003, "Gas microstrip detectors for X-ray tomographic flow imaging", Nucl. Inst. Meth., A496, 504-508.
Jenneson, P.M., Luggar, R.D., Morton, E.J., Gundogdu, O, and Tuzun, U, 2004, "Examining nanoparticle assemblies using high spatial resolution X-ray microtomography", J. App. Phys, 96(5), 2889-2894.
Tavora, L.M., Gilboy, W.B. and Morton, E.J., 2000, "Influence of backscattered electrons on X-ray tube output", Presentation at SPIE Annual Meeting, San Diego, Jul. 30-Aug. 3, 2000.
Wadeson, N., Morton, E.J., and Lionheart, W.B., 2010, "Scatter in an uncollimated x-ray CT machine based on a Geant4 Monte Carlo simulation", SPIE Medical Imaging 2010: Physics of Medical Imaging, Feb. 15-18, 2010, San Diego, USA.

* cited by examiner

X-RAY SOURCES HAVING REDUCED ELECTRON SCATTERING

CROSS-REFERENCE

The present application is a continuation-in-part of U.S. patent application Ser. No. 14/635,814, entitled "X-Ray Sources Having Reduced Electron Scattering" and filed on Mar. 2, 2015, which is a continuation of U.S. patent application Ser. No. 13/313,854, of the same title, and filed on Dec. 7, 2011, now issued U.S. Pat. No. 9,001,973, which, in turn, is a continuation of U.S. patent application Ser. No. 12/478,757 (the '757 Application), filed on Jun. 4, 2009, now issued U.S. Pat. No. 8,094,784, which is a continuation-in-part of U.S. patent application Ser. No. 12/364,067, filed on Feb. 2, 2009, which is a continuation of U.S. patent application Ser. No. 12/033,035, filed on Feb. 19, 2008, which is a continuation of U.S. patent application Ser. No. 10/554,569, filed on Oct. 25, 2005, which is a national stage application of PCT/GB2004/001732, filed on Apr. 23, 2004 and which, in turn, relies on Great Britain Patent Application Number 0309374.7, filed on Apr. 25, 2003, for priority.

The '757 Application also relies on Great Britain Patent Application Number 0812864.7, filed on Jul. 15, 2008, for priority.

The present specification also relates to U.S. patent application Ser. No. 14/930,293, entitled "A Graphite Backscattered Electron Shield for Use in An X-Ray Tube", and filed on Sep. 9, 2015, which is a continuation of U.S. patent application Ser. No. 13/674,086, of the same title, and filed on Nov. 11, 2012, now issued U.S. Pat. No. 9,208,988, which, in turn, is a continuation of U.S. patent application Ser. No. 12/792,931, of the same title and filed on Jun. 3, 2010, now issued U.S. Pat. No. 8,331,535, which, in turn, relies on U.S. Provisional Patent Application No. 61/183,581, filed on Jun. 3, 2009, for priority.

The present specification also relates to U.S. patent application Ser. No. 14/312,525, filed on Jun. 23, 2014, which is a continuation of U.S. patent application Ser. No. 13/063,467, filed on May 25, 2011, which, in turn, is a national stage application of PCT/GB2009/051178, filed on Sep. 13, 2008, and which further relies on Great Britain Patent Application Number 0816823.9, filed on Sep. 11, 2009, for priority.

The present specification also relates to U.S. patent application Ser. No. 14/988,002, filed on Jan. 5, 2016, which is a continuation of U.S. patent application Ser. No. 13/054,066, filed on Oct. 5, 2011, which is a 371 National Stage application of PCT/GB2009/001760, filed on Jul. 15, 2009, while relies on Great Britain Patent Application Number 0812864.7, filed on Jul. 15, 2008, for priority.

All of the aforementioned applications are incorporated herein by reference in their entirety.

FIELD

The present specification relates generally to the field of X-ray sources and more specifically to the design of anodes for X-ray sources along with cooling of the anodes of X-ray tubes.

BACKGROUND

Multi-focus X-ray sources generally comprise a single anode, typically in a linear or arcuate geometry, that may be irradiated at discrete points along its length by high energy electron beams from a multi-element electron source. Such multi-focus X-ray sources can be used in tomographic imaging systems or projection X-ray imaging systems where it is necessary to move the X-ray beam.

When electrons strike the anode they lose some, or all, of their kinetic energy, the majority of which is released as heat. This heat can reduce the target lifetime and it is therefore common to cool the anode. Conventional methods include air cooling, wherein the anode is typically operated at ground potential with heat conduction to ambient through an air cooled heatsink, and a rotating anode, wherein the irradiated point is able to cool as it rotates around before being irradiated once more.

However, there is need for improved anode designs for X-ray tubes that are easy to fabricate while providing enhanced functionality, such as collimation by the anode. There is also need for improved systems for cooling anodes.

SUMMARY

In some embodiments, the present specification discloses an anode for an X-ray tube comprising a source of electrons and multiple channels, each channel comprising: a target defined by a plane; an electron aperture through which electrons from the source of electrons pass to strike said target, wherein said electron aperture comprises side walls, each of said side walls having a surface, and a central axis; and a collimating aperture through which X-rays produced at the target pass out of the anode as a collimated beam, wherein said collimating aperture comprises side walls, each of said side walls having a surface, and a central axis and wherein at least a portion of the surfaces of the side walls of the electron aperture and the surfaces of the side walls of the collimating aperture are lined with an electron absorbing material.

In some embodiments, the electron absorbing material is adapted to absorb any electrons straying from a predefined trajectory. Optionally, the electron absorbing material has a low atomic number. Optionally, the electron absorbing material has a high melting point. Optionally, the electron absorbing material is stable in a vacuum. Optionally, the electron absorbing material is graphite. Optionally, a thickness of the graphite is 0.1 to 2 mm. Optionally, the electron absorbing material is boron. Optionally, the electron absorbing material is titanium.

Optionally, the plane of the target is positioned at an angle relative to a horizontal axis passing through a center of the collimating aperture. Optionally, the angle of the plane of the target relative to a horizontal axis passing through the center of the collimating aperture ranges from 5 degrees to 60 degrees. Optionally, the angle of the plane of the target relative to a horizontal axis passing through the center of the collimating aperture is 30 degrees. Optionally, the plane of the target and the central axis of the collimating aperture are adapted to intersect in a manner that forms an angle, wherein said angle is in a range of 10 degrees to 50 degrees. Optionally, said angle is 30 degrees.

Optionally, the plane of the target is positioned at an angle relative to a vertical axis passing through a center of the electron aperture. Optionally, the angle of the plane the target relative to a vertical axis passing through the center of the electron aperture ranges from 5 degrees to 60 degrees. Optionally, the angle of the plane of the target relative to a vertical axis passing through the center of the electron aperture is 30 degrees.

Optionally, the electron absorbing material on at least a portion of the wall of the electron aperture extends through to block an X-ray beam exit path or collimating aperture. Optionally, the electron absorbing material on the walls of the electron aperture is approximately 1 mm away from a region of the target that is directly irradiated by the electronics.

Optionally, the plane of the target and the central axis of the electron aperture are adapted to intersect in a manner that forms an angle, wherein said angle is in a range of 10 degrees to 50 degrees. Still optionally, said angle is 30 degrees.

Optionally, the central axis of the electron aperture and central axis of the collimating aperture are adapted to intersect in a manner that forms an angle, wherein said angle is in a range of 70 degrees to 110 degrees. Still optionally, said angle is 90 degrees.

It is an object of the present specification to provide an anode for an X-ray tube comprising a target arranged to produce X-rays when electrons are incident upon it, the anode defining an X-ray aperture through which the X-rays from the target are arranged to pass thereby to be at least partially collimated by the anode.

Accordingly, the anode may be formed in two parts, and the X-ray aperture can conveniently be defined between the two parts. This enables simple manufacture of the anode. The two parts are preferably arranged to be held at a common electrical potential.

In one embodiment a plurality of target regions are defined whereby X-rays can be produced independently from each of the target regions by causing electrons to be incident upon it. This makes the anode suitable for use, for example, in X-ray tomography scanning. In this case the X-ray aperture may be one of a plurality of X-ray apertures, each arranged so that X-rays from a respective one of the target regions can pass through it.

In one embodiment the anode further defines an electron aperture through which electrons can pass to reach the target. Indeed the present specification further provides an anode for an X-ray tube comprising a target arranged to produce X-rays when electrons are incident upon it, the anode defining an electron aperture through which electrons can pass to reach the target.

In one embodiment the parts of the anode defining the electron aperture are arranged to be at substantially equal electrical potential. This can result in zero electric field within the electron aperture so that electrons are not deflected by transverse forces as they pass through the electron aperture. In one embodiment the anode is shaped such that there is substantially zero electric field component perpendicular to the direction of travel of the electrons as they approach the anode. In some embodiments the anode has a surface which faces in the direction of incoming electrons and in which the electron aperture is formed, and said surface is arranged to be perpendicular to the said direction.

In one embodiment the electron aperture has sides which are arranged to be substantially parallel to the direction of travel of electrons approaching the anode. In one embodiment the electron aperture defines an electron beam direction in which an electron beam can travel to reach the target, and the target has a target surface arranged to be impacted by electrons in the beam, and the electron beam direction is at an angle of 10° or less, more preferably 5° or less, to the target surface.

It is also an object of the present specification to provide an anode for an X-ray tube comprising at least one thermally conductive anode segment in contact with a rigid backbone and cooling means arranged to cool the anode.

In one embodiment the anode claim further comprises cooling means arranged to cool the anode. For example the cooling means may comprise a coolant conduit arranged to carry coolant through the anode. In one embodiment, the anode comprises a plurality of anode segments aligned end to end. This enables an anode to be built of a greater length than would easily be achieved using a single piece anode. Preferably the anode comprises two parts and the coolant conduit is provided in a channel defined between the two parts.

Each anode segment may be coated with a thin film. The thin film may coat at least an exposed surface of the anode segment and may comprise a target metal. For example, the film may be a film of any one of tungsten, molybdenum, uranium and silver. Application of the metal film onto the surface of the anode may be by any one of sputter coating, electro deposition and chemical deposition. Alternatively, a thin metal foil may be brazed onto the anode segment. The thin film may have a thickness of between 30 microns and 1000 microns, preferably between 50 microns and 500 microns.

In one embodiment, the anode segments are formed from a material with a high thermal conductivity such as copper. The rigid backbone may preferably be formed from stainless steel. The excellent thermal matching of copper and stainless steel means that large anode segments may be fabricated with little distortion under thermal cycling and with good mechanical stability.

The plurality of anode segments may be bolted onto the rigid backbone. Alternatively, the rigid backbone may be crimped into the anode segments using a mechanical press. Crimping reduces the number of mechanical processes required and removes the need for bolts, which introduce the risk of gas being trapped at the base of the bolts.

The integral cooling channel may extend along the length of the backbone and may either be cut into the anode segments or into the backbone. Alternatively, the channel may be formed from aligned grooves cut into both the anode segments and the backbone. A cooling tube may extend along the cooling channel and may contain cooling fluid. Preferably, the tube is an annealed copper tube. The cooling channel may have a square or rectangular cross section or, alternatively, may have a semi-circular or substantially circular cross section. A rounded cooling channel allows better contact between the cooling tube and the anode and therefore provides more efficient cooling.

The cooling fluid may be passed into the anode through an insulated pipe section. The insulated pipe section may comprise two ceramic tubes with brazed end caps, connected at one end to a stainless steel plate. This stainless steel plate may then be mounted into the X-ray tube vacuum housing. The ceramic tubes may be connected to the cooling channel by two right-angle pipe joints and may be embedded within the anode.

The present specification further provides an X-ray tube including an anode according to the specification.

The present specification is also directed to an anode for an X-ray tube comprising an electron aperture through which electrons emitted from an electron source travel subject to substantially no electrical field and a target in a non-parallel relationship to said electron aperture and arranged to produce X-rays when electrons are incident upon a first side of said target, wherein said target further comprises a cooling channel located on a second side of said target. The cooling channel comprises a conduit having coolant contained therein. The coolant is at least one of water, oil, or refrigerant.

The target comprises more than one target segment, wherein each of said target segments is in a non-parallel relationship to said electron aperture and arranged to produce X-rays when electrons are incident upon a first side of said target segment, wherein each of said target segments further comprises a cooling channel located on a second side of said target segment. The second sides of each of said target segments are attached to a backbone. The backbone is a rigid, single piece of metal, such as stainless steel. At least one of said target segments is connected to said backbone using a bolt. At least one of said target segments is connected to said backbone by placing said backbone within crimped protrusions formed on the second side of said target segment. Each of the target segments is held at a high voltage positive electrical potential with respect to said electron source. The first side of each of the target segments is coated with a target metal, wherein said target metal is at least one of molybdenum, tungsten, silver, metal foil, or uranium. The backbone is made of stainless steel and said target segments are made of copper. The conduit is electrically insulated and the cooling channel has at least one of a square, rectangular, semi-circular, or flattened semi-circular cross-section.

In another embodiment, the present specification is directed toward an X-ray tube comprising an anode further comprising at least one electron aperture through which electrons emitted from an electron source travel subject to substantially no electrical field, a target in a non-parallel relationship to said electron aperture and arranged to produce X-rays when electrons are incident upon a first side of said target, wherein said target further comprises a cooling channel located on a second side of said target, and at least one of aperture comprising an X-ray aperture through which the X-rays from the target pass through, and are at least partially collimated by, the X-ray aperture. The cooling channel comprises a conduit having coolant contained therein, such as water, oil, or refrigerant.

The target comprises more than one target segment, wherein each of said target segments is in a non-parallel relationship to said electron aperture and arranged to produce X-rays when electrons are incident upon a first side of said target segment, wherein each of said target segments further comprises a cooling channel located on a second side of said target segment. The second sides of each of said target segments are attached to a backbone. At least one of said target segments is connected to said backbone by a) a bolt or b) placing said backbone within crimped protrusions formed on the second side of said target segment. Each of the target segments is held at a high voltage positive electrical potential with respect to said electron source.

BRIEF DESCRIPTION OF THE DRAWINGS

These and other features and advantages of the present specification will be appreciated as they become better understood by reference to the following Detailed Description when considered in connection with the accompanying drawings, wherein.

DETAILED DESCRIPTION

Figure 1:
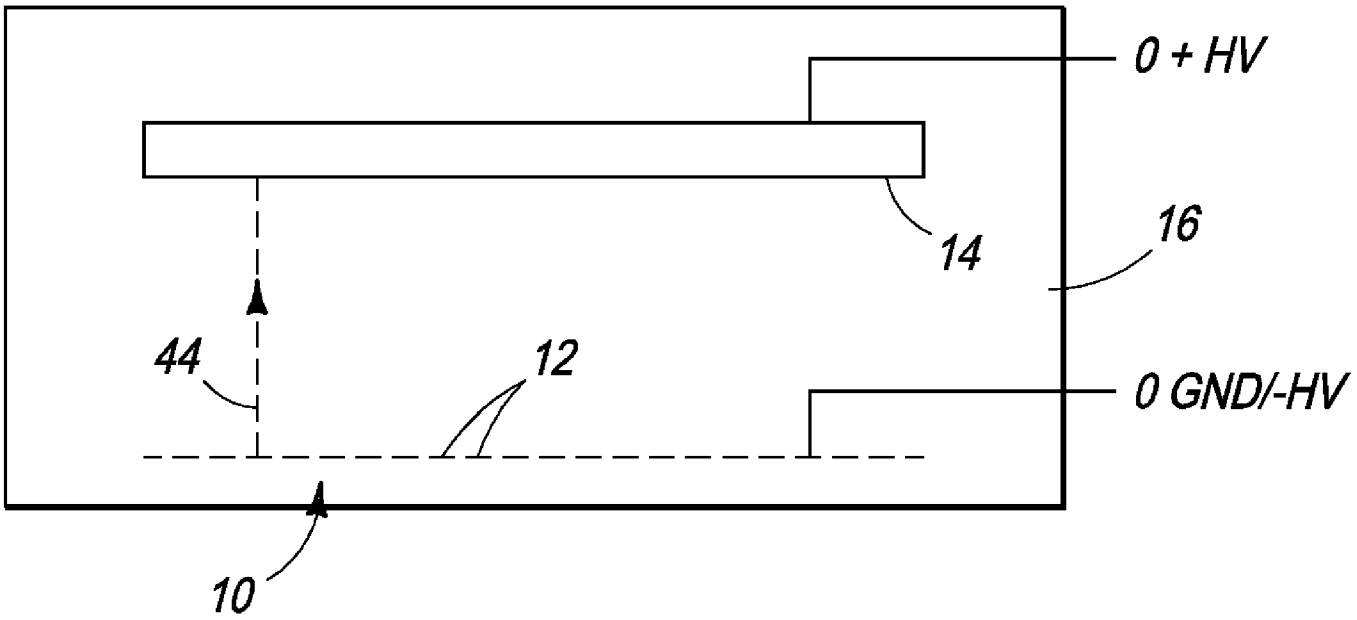
FIG. 1 is a schematic representation of an X-ray tube, in accordance with an embodiment of the present specification.

Referring to FIG. 1, the illustrated X-ray tube comprises a multi-element electron source 10 comprising a number of elements 12, each arranged to produce a respective beam of electrons, and a linear anode 14, both enclosed in a tube envelope 16. The electron source elements 12 are held at a high voltage and negative electrical potential with respect to the anode 14.

Figure 2:
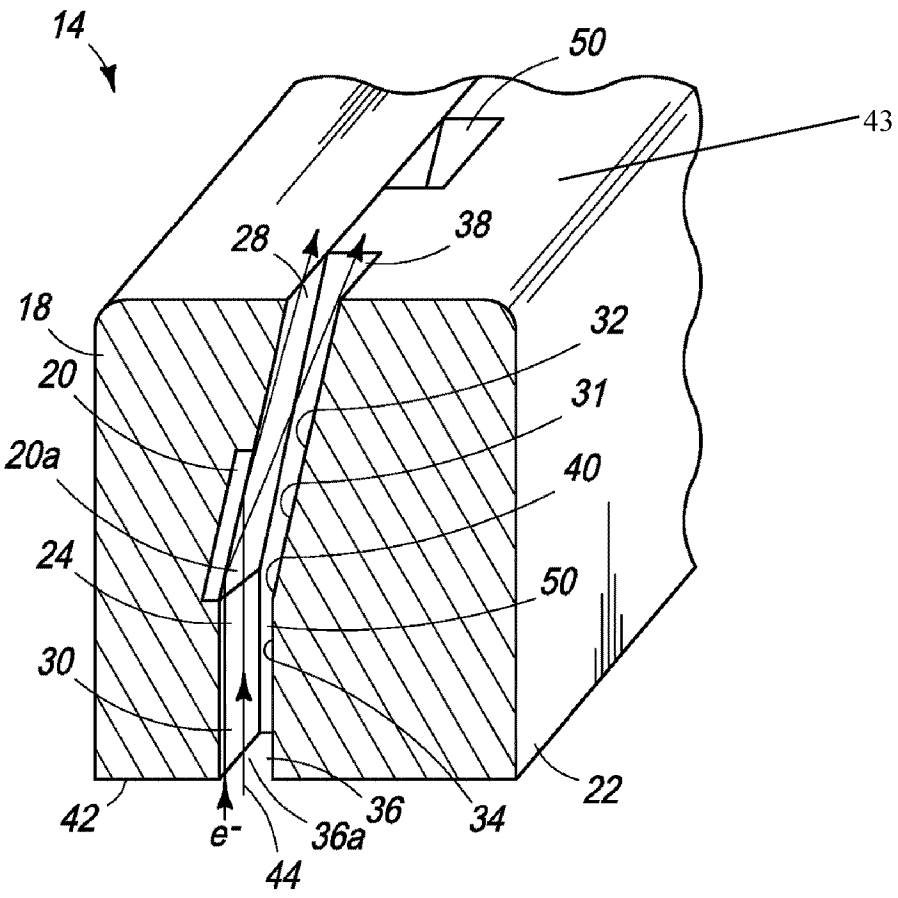
FIG. 2 is a partial perspective view of an anode, in accordance with an embodiment of the present specification.

Referring to both FIG. 1 and FIG. 2, the anode 14 is formed in two parts: a main part 18 which has a target region 20 formed on it, and a collimating part 22, both of which are held at the same positive potential, being electrically connected together. The main part 18 comprises an elongate block having an inner side 24 which is generally concave and made up of the target region 20, an X-ray collimating surface 28, and an electron aperture surface 30. The collimating part 22 extends parallel to the main part 18. The collimating part 22 of the anode is shaped so that its inner side 31 fits against the inner side 24 of the main part 18, and has a series of parallel channels 50 formed in it such that, when the two parts 18, 22 of the anode are placed in contact with each other, they define respective electron apertures 36 and X-ray apertures 38. Each electron aperture 36 extends from the surface 42 of the anode 14 facing the electron source to the target 20, and each X-ray aperture extends from the target 20 to the surface 43 of the anode 14 facing in the direction in which the X-ray beams are to be directed. A region 20*a* of the target surface 20 is exposed to electrons entering the anode 14 through each of the electron apertures 36, and those regions 20*a* are treated to form a number of discrete targets.

In this embodiment, the provision of a number of separate apertures through the anode 14, each of which can be aligned with a respective electron source element, allows good control of the X-ray beam produced from each of the target regions 20*a*. This is because the anode can provide collimation of the X-ray beam in two perpendicular directions. The target region 20 is aligned with the electron aperture 36 so that electrons passing along the electron aperture 36 will impact the target region 20. The two X-ray collimating surfaces 28, 32 are angled slightly to each other so that they define between them an X-ray aperture 38 which widens slightly in the direction of travel of the X-rays away from the target region 20. The target region 20, which lies between the electron aperture surface 30 and the X-ray collimating surface 28 on the main anode part 18 faces the region 40 of the collimating part 22. Electron aperture surface 34 and X-ray collimating surface 32 meet at the region 40.

Adjacent the outer end 36*a* of the electron aperture 36, the surface 42 is substantially flat and perpendicular to the electron aperture surfaces 30, 34 and the direction of travel of the incoming electrons. Surface 42 faces the incoming electrons and is made up on one side of the electron aperture 36 by the main part 18 and on the other side by the collimating part 22. This means that the electrical field in the path of the electrons between the source elements 12 (shown in FIG. 1) and the target 20 is parallel to the direction of travel of the electrons between the source elements 12 and the surface 42 of the anode facing the source elements 12. Therefore, there is substantially no electric field within the electron aperture 36, and the electric potential within aperture 36 is substantially constant and equal to the anode potential.

In use, each of the source elements 12 is activated in turn to project a beam 44 of electrons at a respective area of the target region 20. The use of successive source elements 12 and successive areas of the target region enables the position of the X-ray source to be scanned along the anode 14 in the longitudinal direction perpendicular to the direction of the incoming electron beams and the X-ray beams. As the electrons move in the region between the source 12 and the anode 14 they are accelerated in a straight line by the electric field which is substantially straight and parallel to the required direction of travel of the electrons. Once the electrons enter the electron aperture 36 they encounter a region of zero electric field up to the point of impact with the target 20. Therefore, throughout the length of the path of the electrons within anode 14, the electrons are not subjected to any electric field having a component perpendicular to the direction of travel. However, in an embodiment, electrical field(s) may be provided to focus the electron beam. Hence, the path of the electrons as they approach the target 20 is substantially straight, and is unaffected by, for example, the potentials of the anode 14 and source 12, and the angle of the target 20 to the electron trajectory.

When the electron beam 44 hits the target 20 some of the electrons produce fluorescent radiation at X-ray energies. The produced radiation is radiated from the target 20 over a broad range of angles. However the anode 14, being made of a metallic material, provides a high attenuation of X-rays, so that only the X-rays that leave the target 20 in the direction of the collimating aperture 38 avoid being absorbed within the anode 14. The anode 14, therefore, produces a collimated beam of X-rays, the shape of which is defined by the shape of the collimating aperture 38. In an embodiment, further collimation of the X-ray beam may also be provided, by using conventional means external to the anode 14.

Some of the electrons in the beam 44 are backscattered from the target 20. Backscattered electrons normally travel to the tube envelope where they can create localized heating of the tube envelope or build up surface charge that can lead to tube discharge. Both of these effects can lead to reduction in lifetime of the tube. In various embodiments, electrons backscattered from the target 20 may interact with the collimating part 22 or the main part 18 of the anode 14. However, since, the energetic electrons are absorbed back into the anode 14, excess heating, or surface charging of the tube envelope 16 is prevented. The backscattered electrons typically have a lower energy than the incident (full energy) electrons and are more likely to result in lower energy bremsstrahlung radiation than fluorescence radiation. In embodiments, any bremsstrahlung radiation produced is also absorbed within the anode 14.

With reference to FIG. 2, the angle of placement of target 20 with respect to the direction of the incoming electron beam 44 is less than 10°, causing the electrons to hit the target 20 at a glancing angle. In an embodiment, the angle of placement of target 20 with respect to the direction of the incoming electron beam 44 is about 5°. In an embodiment, the angle between the X-ray aperture 38 and the electron aperture 36 ranges around 10°. In conventional electron tubes, the incoming electrons tend to be deflected by the electric field from the target before hitting it, due to the high component of the electric field in the direction transverse to the direction of travel of the electrons. This makes glancing angle incidence of the electrons on the anode very difficult to achieve. However, in the present embodiment, the region within the electron aperture 36 and the X-ray aperture 38 is at a substantially constant potential providing a substantially zero electric field. Therefore, the incoming electrons travel in a straight line until they impact the target 20. Further, since in the embodiment illustrated in FIG. 2, a relatively large area of the target 20 (wider than the incident electron beam) is used, the heat load is spread throughout the target 20, thereby improving the efficiency and lifetime of the target.

Figure 3:
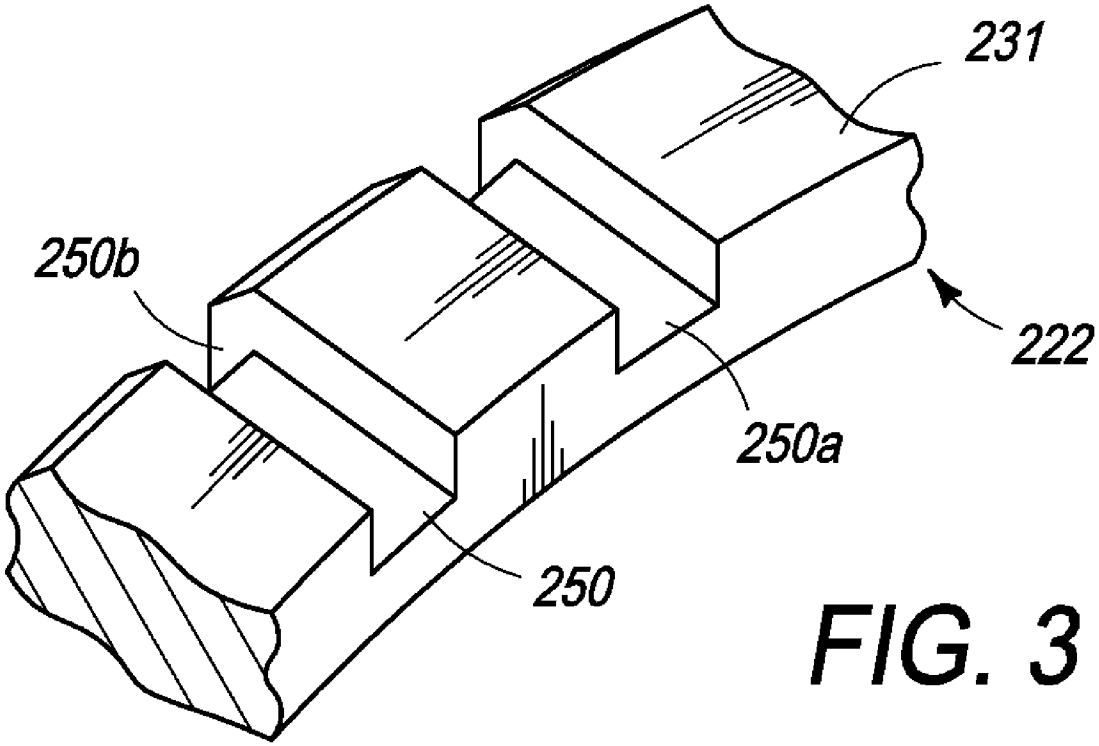
FIG. 3 is a partial perspective view of an anode, in accordance with another embodiment of the present specification.
Figure 4:
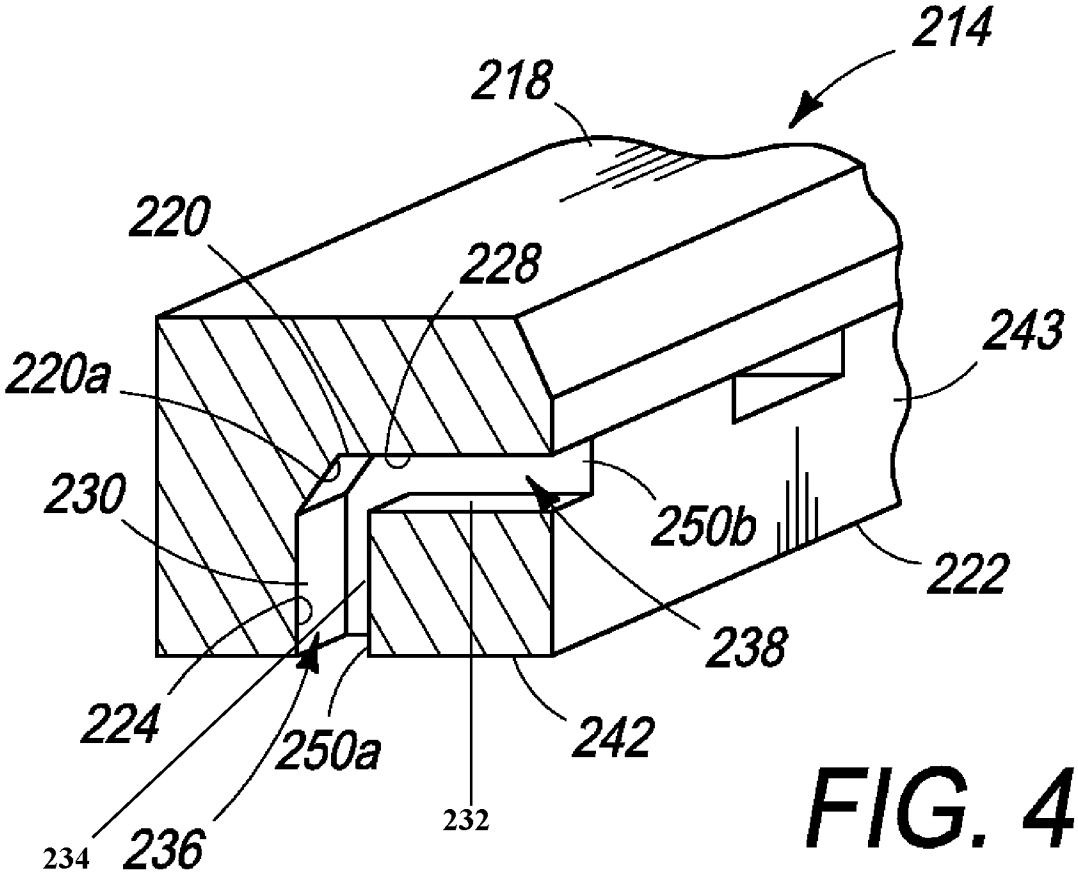
FIG. 4 is another partial perspective view of the anode of FIG. 3.

Referring to FIGS. 3 and 4, another embodiment of the anode of the present specification is illustrated. The parts of the anode corresponding to those in FIG. 2 are indicated by the same reference numeral increased by 200. A main part 218 of the anode is shaped in a similar manner to that of the anode illustrated in FIG. 2, having an inner side 224 comprising a target surface 220, an X-ray collimating surface 228. An electron aperture surface 230 is angled at about 11° to the collimating surface 228. The collimating part 222 of the anode comprises a series of parallel channels 250 formed in it. Each channel 250 comprises an electron aperture part 250*a*, and an X-ray collimating part 250*b* such that, when the two parts 218, 222 of the anode are placed in contact they define respective electron apertures 236 and X-ray apertures 238. The two X-ray collimating surfaces 228, 232 are angled at about 90° to the electron aperture surfaces 230, 234 but are angled slightly to each other so that they define between them the X-ray aperture 238 which is at about 90° to the electron aperture 236.

As shown in FIGS. 3 and 4 the collimating apertures 238 broaden out in a horizontal direction, but are of substantially constant height. This produces a fan-shaped beam of X-rays suitable for use in tomographic imaging. However, it will be appreciated, that the beams could be made substantially parallel, or spreading out in both horizontal and vertical directions, depending on the needs of a particular application.

Figure 5:
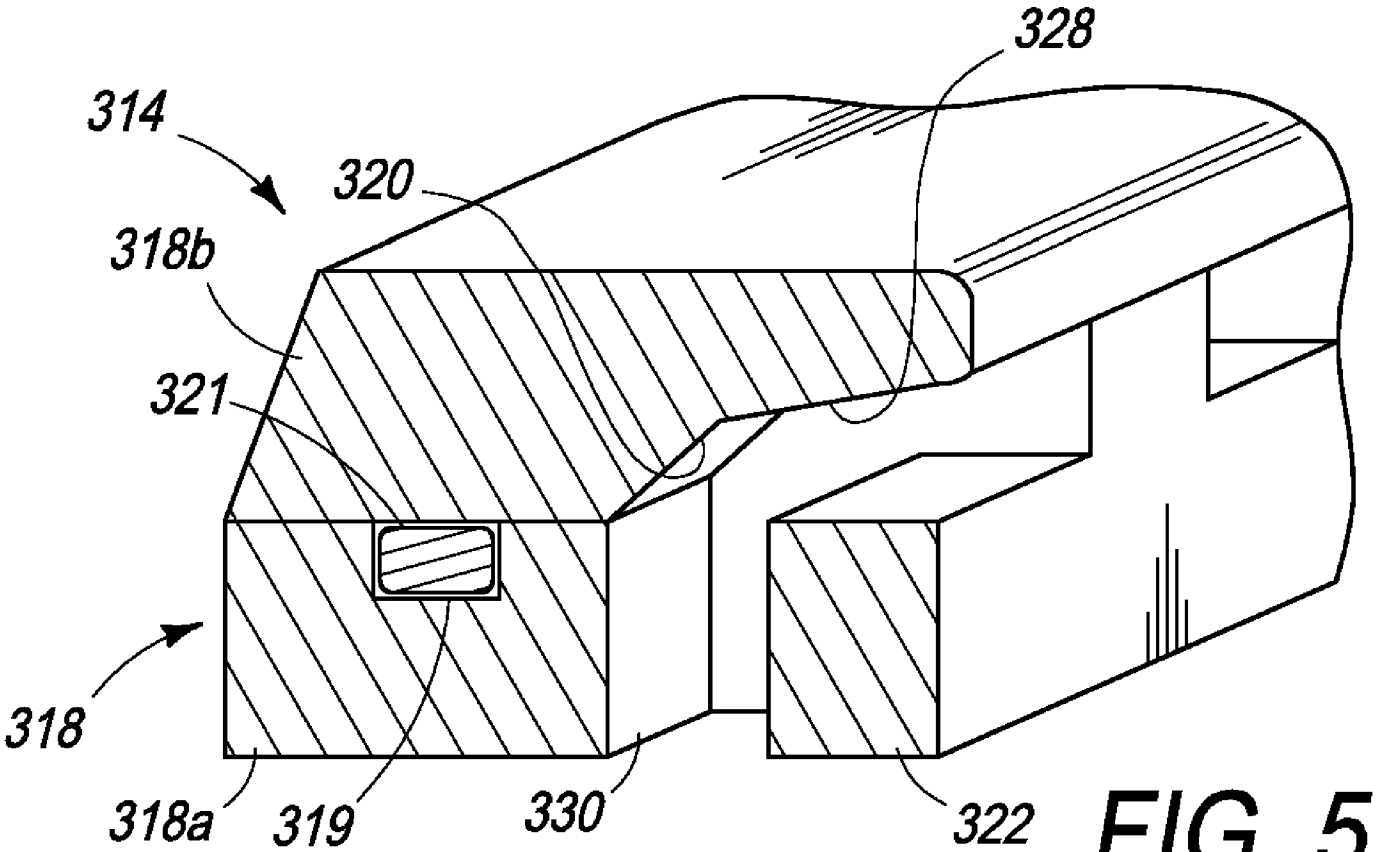
FIG. 5 is a partial perspective view of an anode, in accordance with yet another embodiment of the present specification.

Referring to FIG. 5, in another embodiment of the present specification, the anode comprises a main part 318 and a collimating part 322 as shown. The parts of the anode corresponding to those in FIG. 2 are indicated by the same reference numeral increased by 300. The main part 318 is split into two sections 318*a*, and 318*b*, wherein 318*a* comprises electron aperture surface 330, and 318*b* comprises target region 320 and X-ray collimating surface 328. Section 318*a* also comprises a channel 319 formed parallel to the target region 320, i.e. perpendicular to the direction of the incident electron beam and the direction of the X-ray beam. Channel 319 is sealed by section 318*b* and has a coolant conduit in the form of a ductile annealed copper pipe 321 fitted inside. Copper pipe 321 is shaped so as to be in close thermal contact with the two sections 318*a* and 318*b*. The pipe 321 forms part of a coolant circuit, wherein a coolant fluid, such as a transformer oil or fluorocarbon, maybe circulated through pipe 321 to cool the anode 314. It will be appreciated that similar cooling could be provided in the collimating part 322 if required.

Figure 6A:
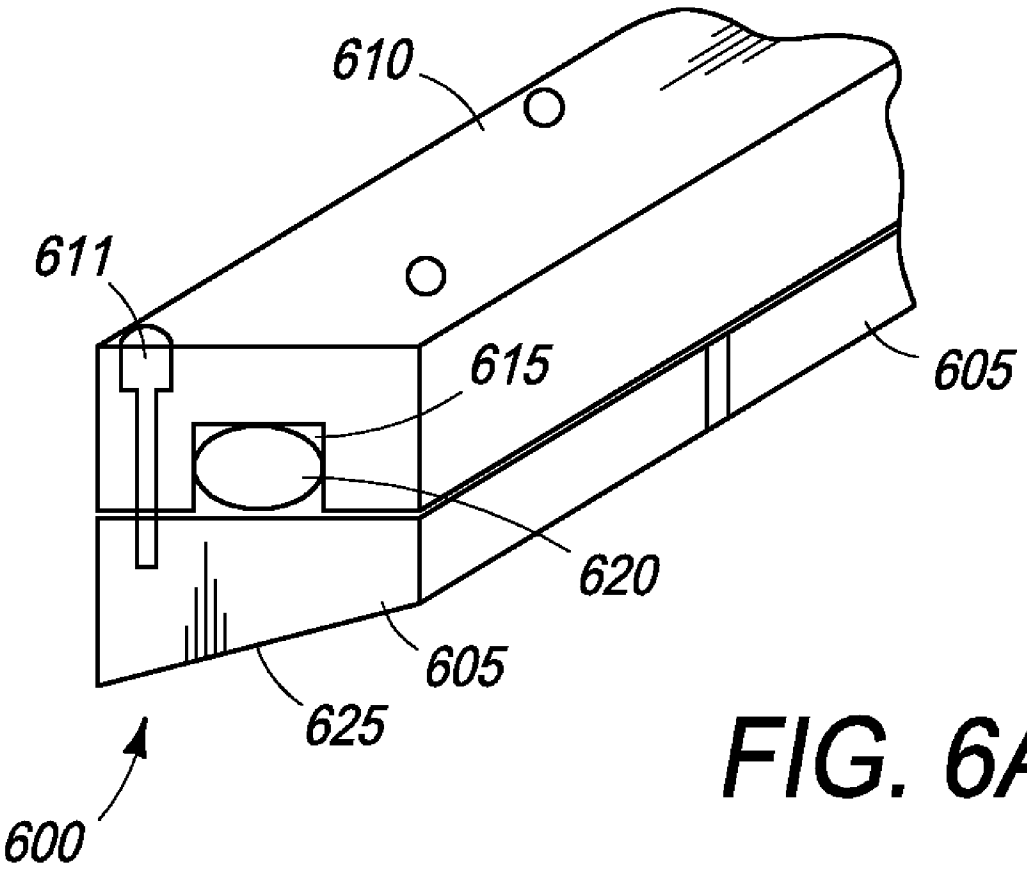
FIG. 6*a* is a cross sectional view of an anode, in accordance with another embodiment of the present specification.
Figure 6B:
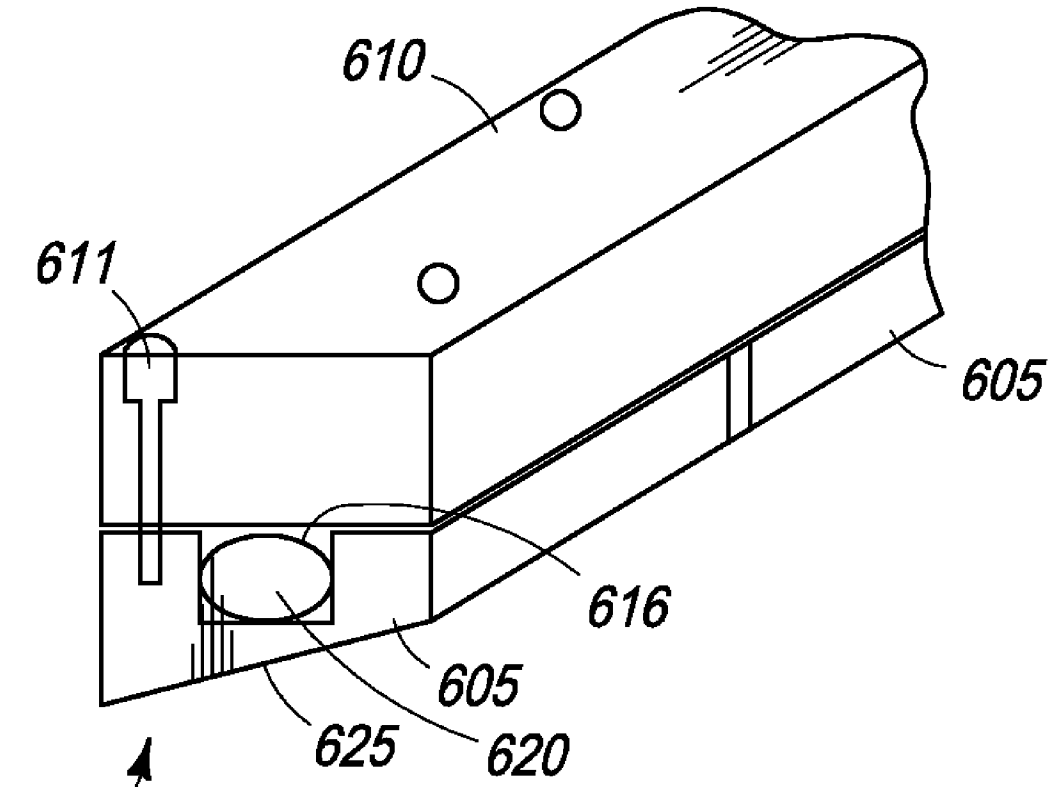
FIG. 6*b* is a cross sectional view of an anode, in accordance with another embodiment of the present specification.

Referring to FIGS. 6*a* and 6*b*, an anode 600, according to one embodiment of the present specification, comprises a plurality of thermally conductive anode segments 605 bolted to a rigid single piece backbone 610 by bolts 611. A cooling channel 615 extends along the length of the anode between the anode segments 605 and the backbone 610 and contains a coolant conduit in the form of a tube 620 arranged to carry the cooling fluid.

The anode segments 605 are formed from a metal such as copper and are held at a high voltage positive electrical potential with respect to an electron source. Each anode segment 605 has an angled front face 625, which is coated with a suitable target metal such as molybdenum, tungsten, silver or uranium selected to produce the required X rays when electrons are incident upon it. This layer of target metal is applied to the front surface 625 using any suitable methods, such as but not limited to, sputter coating, electrodeposition and chemical vapor deposition. Alternatively, a thin metal foil with a thickness of 50-500 microns is brazed onto the copper anode surface 625.

Referring to FIG. 6*a*, the cooling channel 615 is formed in the front face of the rigid backbone 610 and extends along the length of the anode. In one embodiment the cooling channel 615 has a square or rectangular cross-section and contains an annealed copper coolant tube 620, which is in contact with both the copper anode segments 605, the flat rear face of which forms the front side of the channel, and the backbone 610. A cooling fluid such as oil is pumped through the coolant tube 620 to remove heat from the anode 600.

FIG. 6*b* shows an alternative embodiment in which the cooling channel 616 is cut into the anode segments 605. In one embodiment the cooling channel 616 has a semi-circular cross section with a flat rear surface of the channel being provided by the backbone 610. The semi-circular cross section provides better contact between the coolant tube 620 and the anode segments 605, thereby improving the efficiency of heat removal from the anode 600. Alternatively, the cooling channel 616 may comprise two semi-circular recesses in both the backbone 610 and the anode segments 605, forming a cooling channel with a substantially circular cross-section.

In one embodiment the rigid single piece backbone 610 is formed from stainless steel and can be made using mechanically accurate and inexpensive processes such as laser cutting while the smaller copper anode segments 605 are typically fabricated using automated machining processes. The backbone 610 is formed with a flat front face and the anode segments 605 are formed with flat rear faces to ensure good thermal contact between them when these flat faces are in contact. Due to the excellent thermal matching of copper and stainless steel and good vacuum properties of both materials, large anode segments having good mechanical stability and minimal distortion under thermal cycling may be fabricated.

The bolts 611 fixing the anode segments 605 onto the backbone 610 pass through bores that extend from a rear face of the backbone, passing through to a front face of the backbone 610, and into threaded blind bores in the anode segments 605. During assembly of the anode 600, there is potential for gas pockets to be trapped around the base of these bolts 611. Small holes or slots may therefore be cut into the backbone or anode to connect these holes to the outer surface of the backbone or anode, allowing escape of the trapped pockets of gas.

In accordance with an aspect of the present specification, bolting a number of anode segments 605 onto a single backbone 610, as shown in FIGS. 6*a* and 6*b*, provides an anode extending for several meters. This would otherwise generally be expensive and complicated to achieve.

Figure 7:
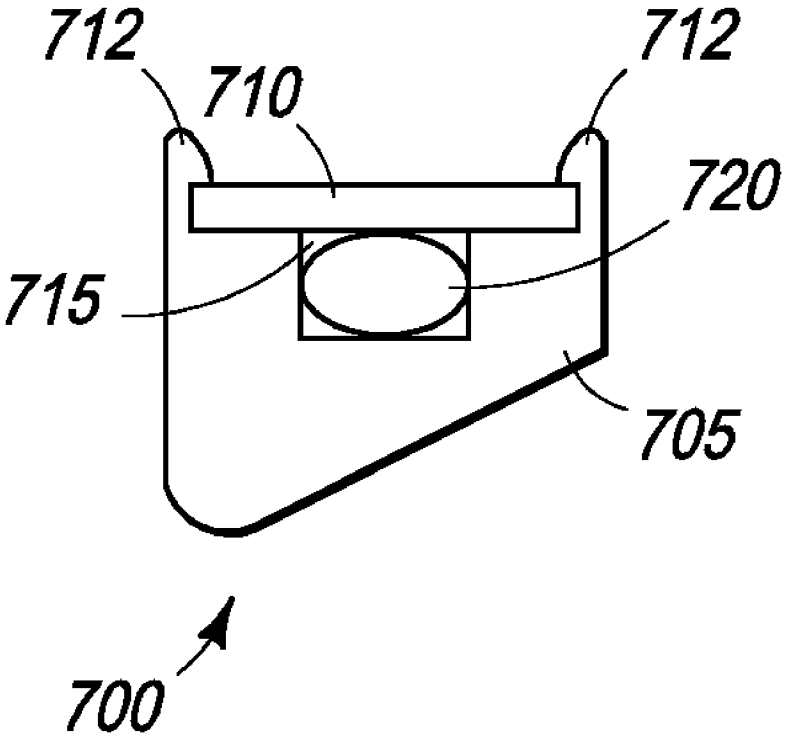
FIG. 7 shows an anode segment crimped to a backbone, in accordance with an embodiment of the present specification.

FIG. 7 shows an alternative design of the anode shown in FIGS. 6A and 6B. As shown, anode 700 comprises a single piece rigid backbone 710 in the form of a flat plate which is crimped into anode segments 705 using a mechanical press. The crimping process causes holding members 712 to form in the back of the anode segments 705, thereby defining a space for holding the backbone 710. In one embodiment, a square cut cooling channel 715 is cut into the back surface of the anode segments 705 and extends along the length of the anode, being covered by the backbone 710. Coolant fluid is passed through an annealed copper coolant tube 720, which sits inside the cooling channel 715, to remove heat generated in the anode 700. This design reduces the machining processes required in the anode and also removes the need for bolts and the associated potential of trapped gas volumes at the base of the bolts.

Figure 8:
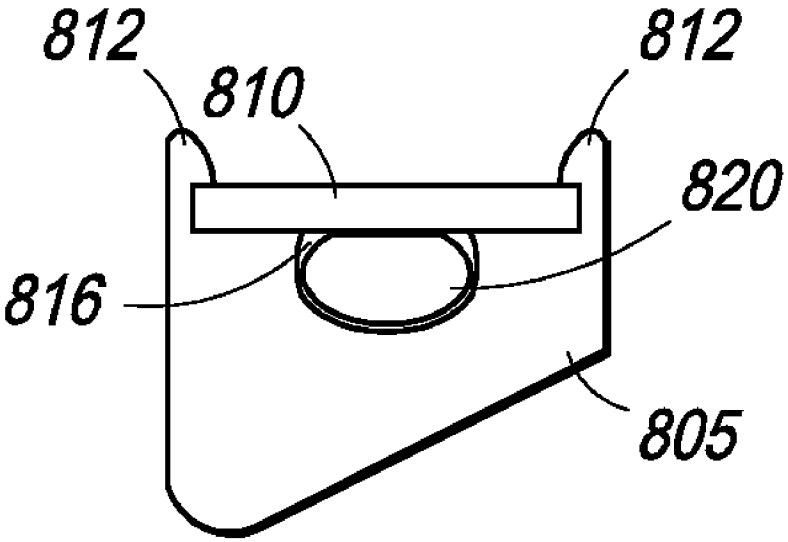
FIG. 8 shows the anode of FIG. 7 with a round-ended cooling channel, in accordance with an embodiment of the present specification.

FIG. 8 illustrates another anode design similar to that shown in FIG. 7. As shown, a rigid backbone 810 is crimped into anode segments 805. The crimping process causes holding members 812 to form in the back of the anode segments 805, thereby defining a space for holding the backbone 810. A cooling channel 816 having a curved semi-elliptical cross-section extends along the length of the anode 800 and is cut into the anode segments 805 with a round-ended tool. A coolant tube 820, which is of a rounded shape, sits inside the cooling channel 816 and is filled with a cooling fluid such as oil, water or a refrigerant. The rounded cooling channel 816 provides superior contact between the coolant tube 820 and the anode segments 805.

Figure 9:
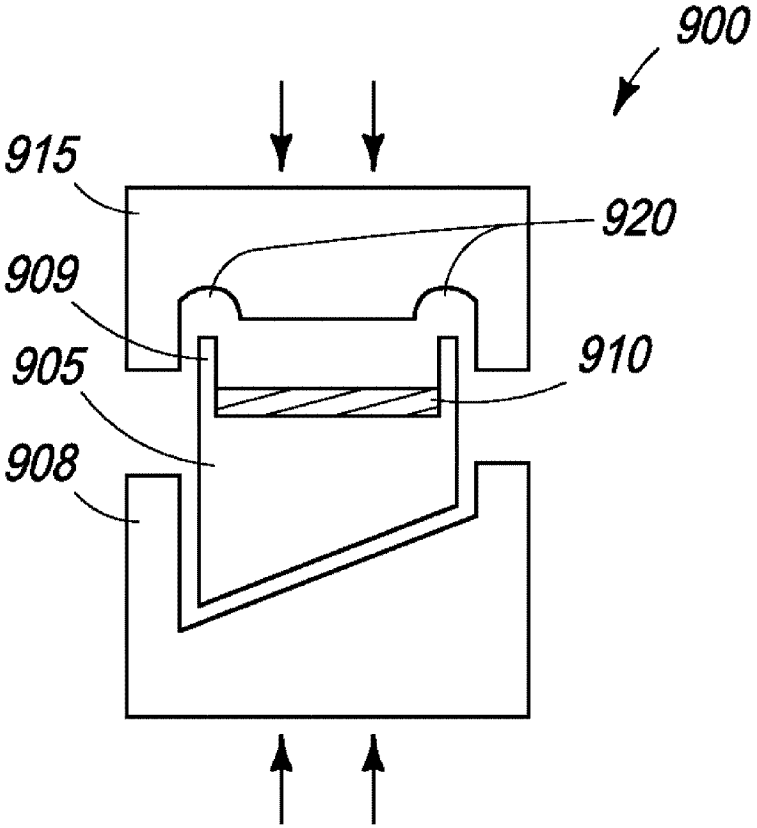
FIG. 9 shows the crimping tool used to crimp an anode segment to a backbone, in accordance with an embodiment of the present specification.

FIG. 9 illustrate a crimping tool, which in embodiments is used to form anodes such as those shown in FIGS. 7 and 8. Coated copper anode segments 905 are supported in a base support 908 with walls 909 projecting upwards from the sides of the rear face of the anode segments 905. Rigid backbone 910 is placed onto the anode segments 905, fitting between the projecting anode walls 909. An upper part 915 of the crimp tool 900 has grooves 920 of a rounded cross section formed in it. The grooves 920 are arranged to bend over and deform the straight copper walls 909 of the anode segments 905 against the rear face of the backbone as it is lowered towards the base support 908, crimping the backbone 910 onto the anode segments 905. Typically a force of 0.3-0.7 ton/cm length of anode segment is required to complete the crimping process. As a result of the crimping process the crimped edges of the anode segments form a continuous rounded ridge along each side of the backbone. It will be appreciated that other crimping arrangements may be used. For example, the anode segments may be crimped into grooves in the sides of the backbone, or the backbone may be crimped into engagement with the anode.

In use, the anode segments 905 are held at a relatively high electrical potential. Any sharp points on the anode can therefore lead to a localized high build up of electrostatic charge and result in electrostatic discharge. Crimping the straight copper walls 909 of the anode segments 905 around the backbone 910 provides the anode segments with rounded edges and avoids the need for fasteners such as bolts. This helps to ensure an even distribution of charge over the anode and reduces the likelihood of electrostatic discharge from the anode.

Since the anode is often operated at positive high voltage with respect to ground potential, in order to pass the coolant fluid into the anode it is often necessary to use an electrically insulated pipe section. Non-conducting tube sections (such as those made of ceramic) may be used to provide an electrically isolated connection between coolant tubes and an external supply of coolant fluid. The coolant fluid is pumped through the ceramic tubes into the coolant tube, removing the heat generated as X-rays are produced.

Figure 10:
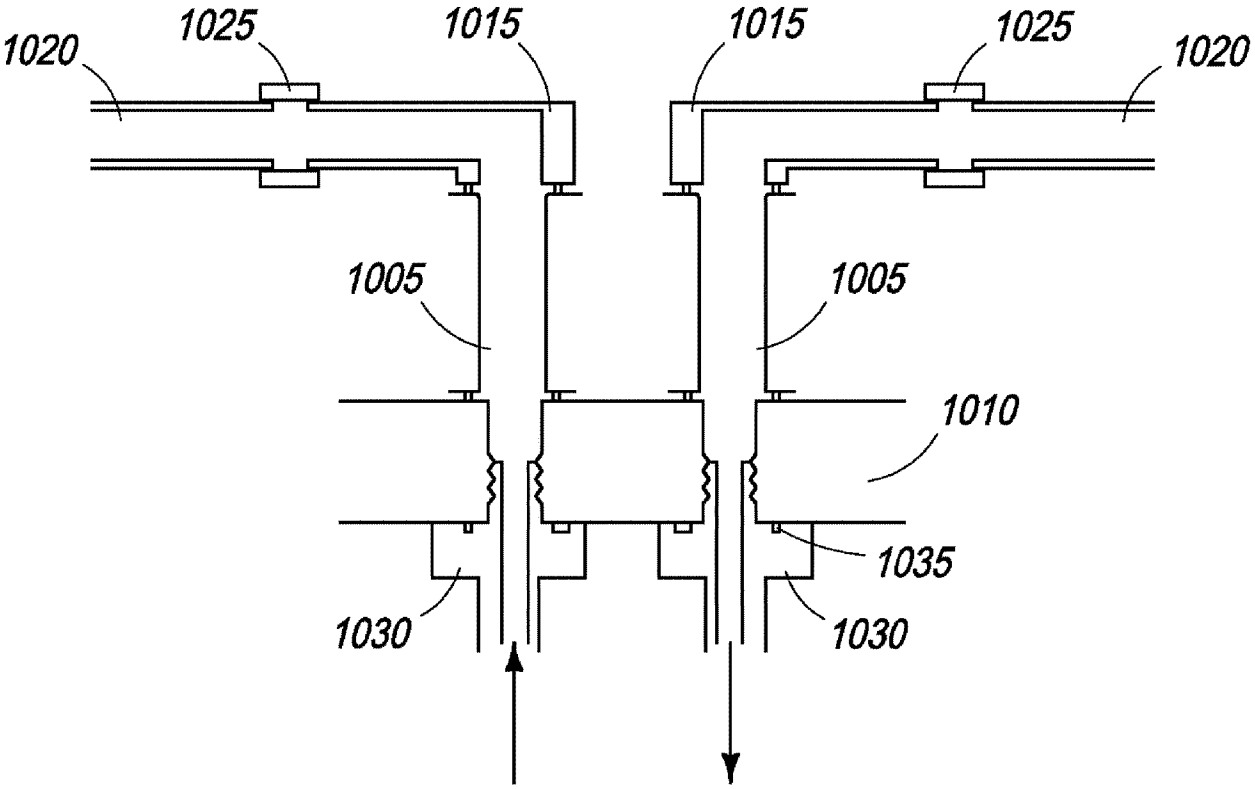
FIG. 10 shows an insulated pipe section for connection to a coolant tube in a coolant channel, in accordance with another embodiment of the present specification.

FIG. 10 shows an insulated pipe section comprising two ceramic breaks 1005 (ceramic tubes with brazed end caps) welded at a first end to a stainless steel plate 1010. This stainless steel plate 1010 is then mounted into an X-ray tube vacuum housing. As shown in the figure, one end of each of two right-angle sections 1015 are welded at a first and a second end of the ceramic breaks 1005. The other ends of the right-angle sections 1015 are then brazed to the coolant tube 1020, which extends along the cooling channels (615, 616 shown in FIGS. 6*a* and 6*b*) of the anode. A localized heating method such as induction brazing using a copper collar 1025 around the coolant tube 1020 and right angle parts 1015 is employed. Threaded connectors 1030 on the external side of the stainless steel plate 1010 attach the insulated pipe section to external coolant circuits. These connectors 1030 may be welded to the assembly or screwed in using O-ring seals 1035, for example.

In order to maximize the electrostatic performance of the anode 600 of FIGS. 6*a* and 6*b*, it is advantageous to embed the high voltage right-angle sections of the coolant assembly, such as those shown in FIG. 10, within the anode itself. After connecting the insulated pipe section to the coolant tube, it may not be possible to crimp the backbone in the anode segments, and mechanical fixing means (such as the bolts 611 shown in FIGS. 6*a* and 6*b*) may be required.

Figure 11:
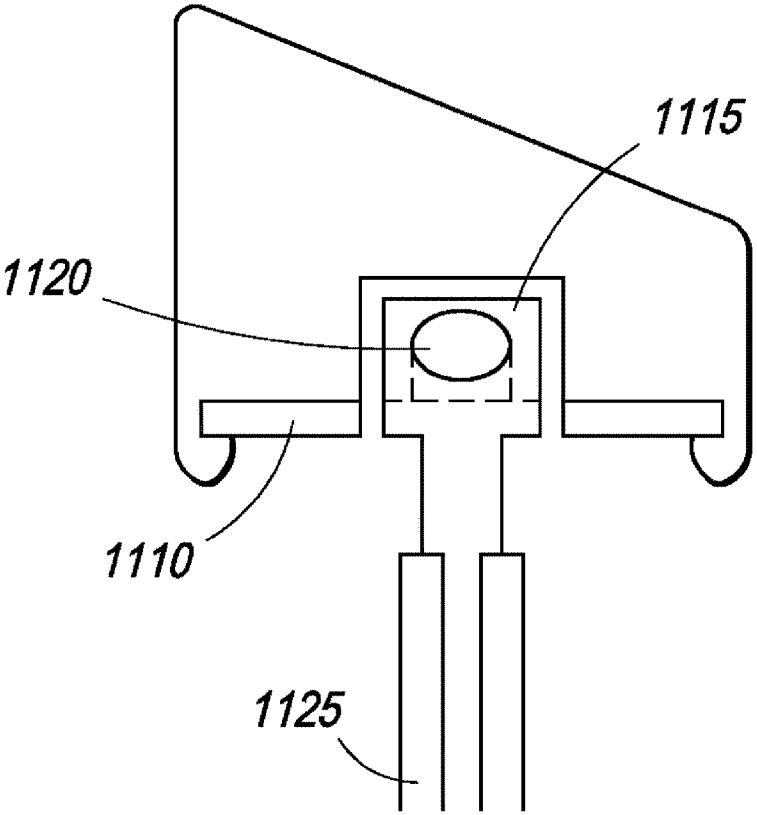
FIG. 11 shows the insulated pipe section of FIG. 10 connected to a coolant tube in accordance with another embodiment of the present specification.

Alternatively, in an embodiment, the pipe section may be connected to a crimped anode from outside of the anode. Referring to FIG. 11, a gap is cut into the rigid backbone 1110. The right angle sections 1115 extend through the gap in the backbone 1110 and are brazed at one end onto the coolant tube 1120. On an external side of the rigid backbone 1110 the right angle sections are welded onto ceramic breaks 1125, which are connected to external cooling circuits.

While the presence of copper in the target (high Z material) attenuates X-rays that are not generated in the required beam path, a low atomic number (for example, graphite) lining is employed to attenuate the electrons that either stray from the main electron beam path from the filament to target or that are backscattered from the target. Thus, in an embodiment, the present specification provides for lining the walls of electron apertures and/or collimating apertures of an anode with a material, such as graphite, for absorbing any stray or backscattered electrons and low energy X-rays. Graphite is advantageous in that it stops backscattered electrons but is inefficient at generating X-rays or attenuating the X-rays that are produced from a designated part of the anode. Electrons having an energy of approximately 160 kV have a travel range of 0.25 mm within graphite. Hence, in an embodiment, a graphite lining, having a thickness ranging from 0.1 mm to 2 mm, is used to prevent any electrons from passing through. Graphite is both electrically conductive and refractory and can withstand very high temperatures during processing or operation. Further, X-ray generation in the graphite lining (either by incident or backscattered electrons) is minimized due to the low atomic number (Z) of graphite (Z=6). The shielding properties of graphite are described in U.S. patent application Ser. No. 14/930,293, which is incorporated herein by reference in its entirety.

It should be noted herein that any material that has properties similar to graphite that achieve the intended purpose may be used in the anode structures of the present specification. In other embodiments, materials such as boron or titanium that are characterized by low atomic number, high melting point (refractory) and stable performance in a vacuum may be used for lining the channels of the anode of the present specification. It should be noted herein and understood by those of ordinary skill in the art that considerations for material choice may also include cost and manufacturability.

Referring to FIG. 2, the target surface 20 is exposed to electron beam 44 entering the anode 14 through each of the electron apertures 36. Each target region 20 is aligned with an electron aperture 36 and an electron source element so that electrons 44 emitted by the source element passing along the electron aperture 36 impact the target region 20. As the electrons 44 move in the region between the electron source element and the anode 14, they are accelerated in a straight line by an electric field which is substantially straight and parallel to the required direction of travel of the electrons. This causes the electrons 44 to follow a trajectory leading up to the target 20. However, some of the electrons 44 passing through the electron aperture 36 may stray from the desired trajectory leading up to the target 20. Some of the electrons in the beam 44 may also be backscattered from the target 20. In an embodiment, the parallel walls/surfaces 30, 34 of the electron aperture 36 are lined with a material that can absorb the electrons straying from the desired trajectory. In an embodiment, a graphite layer, having a thickness ranging from 0.1 mm to 2 mm, is used to line the walls 30, 34 of the electron aperture 36 for absorbing any stray electrons. In an embodiment, the graphite layer is 1 mm thick.

As shown in FIG. 2, the anode 14 comprises a collimating part 22 having two X-ray collimating surfaces 28, 32 angled to each other such that they define between them an X-ray aperture 38. When the electron beam 44 hits the target 20 some of the electrons produce radiation at X-ray energies. This X radiation passes through the collimating X-ray aperture 38 which causes a collimated beam of X-rays to leave the anode 14. Some of the produced radiation that does not travel in the desired direction specified by the collimating X-ray aperture 38 are absorbed by the walls/surfaces 28, 32 of the collimating aperture 38, which in an embodiment, are lined with an electron absorbing material. In an embodiment, a graphite layer, having a thickness ranging from 0.1 mm to 2 mm, is used to line the walls 28, 32 of the X-ray aperture 38 for absorbing any stray electrons. In an embodiment, the graphite layer is 1 mm thick.

Figure 12:
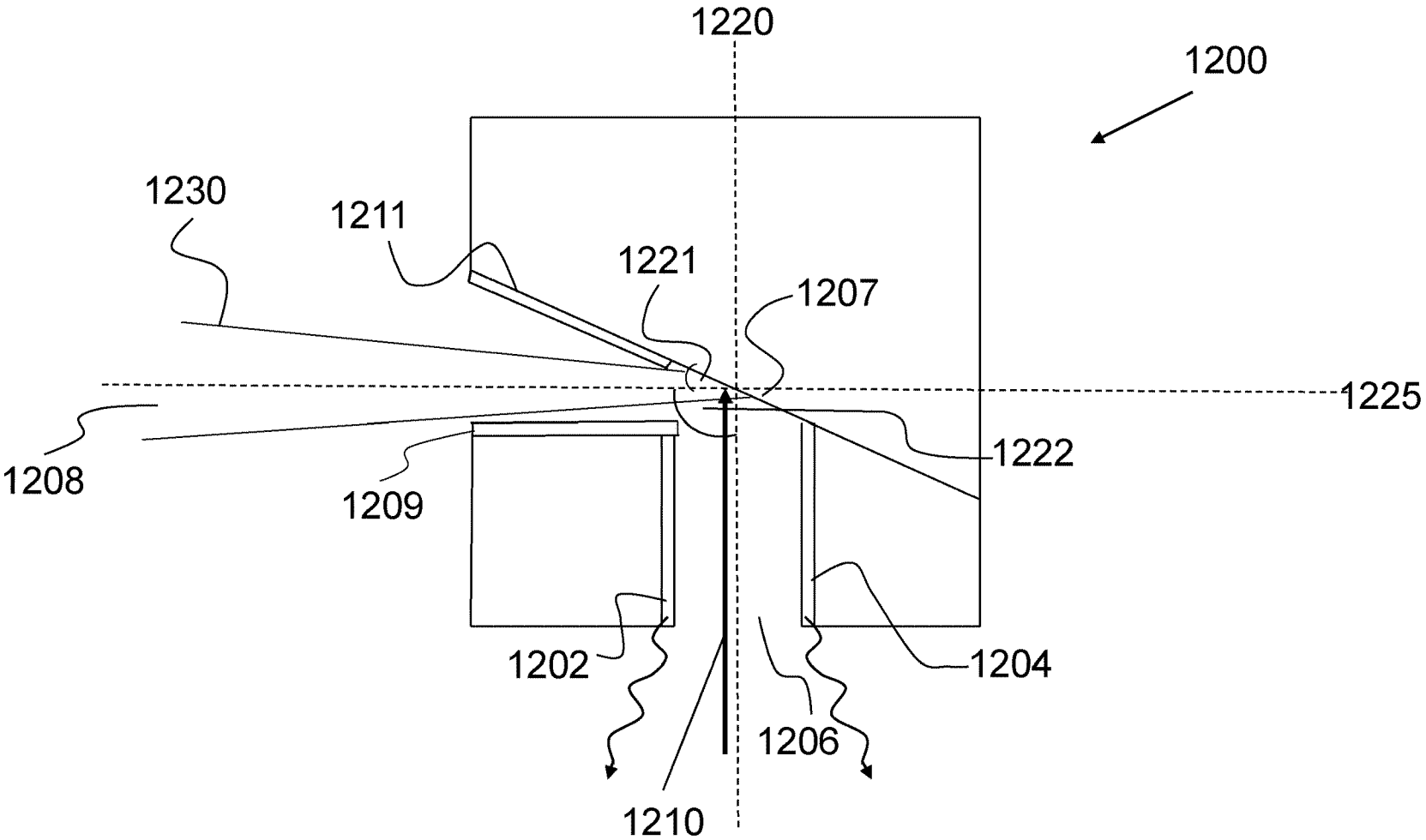
FIG. 12 illustrates an anode comprising channels lined with graphite, in accordance with an embodiment of the present specification.

FIG. 12 illustrates an embodiment of the anode where the walls of an electron aperture of an anode are lined with graphite, in accordance with an embodiment of the present specification. Anode 1200 comprises an electron aperture 1206, a target 1207 and a collimating aperture 1208. An electron beam 1210 entering the electron aperture 1206 strikes the target 1207 and the emitted X-ray beam 1230 exits the anode 1200 via the collimating aperture 1208. In an embodiment, the parallel walls 1202, 1204 of electron aperture 1206 are lined with a layer of graphite. Any stray electrons from an incident electron beam 1208 that do not travel in a direction specified by the electron aperture 1206 are absorbed by the graphite layer. Further, any backscattered electrons generated when the electron beam 1210 strikes the target 1207 are also absorbed by the graphite layer. Also, in an embodiment, as explained above at least a portion of the walls 1209, 1211 of the collimating aperture 1208 are also lined with graphite in order to absorb any electrons straying into the collimating aperture 1208.

The relative dimensions of the directionality of the apertures and target surface are largely application dependent. In an embodiment, the ratio of width to height of electron aperture 1206 is on the order of 1 or greater (i.e. at least square and in some embodiments, rectangular). The ratio of length to width of electron aperture 1206 is also application dependent. In an embodiment, for cone beam systems, the ratio of length to width for electron aperture 1206 is approximately 1. In an embodiment, for fan beam systems, the ratio of length to width for electron aperture 1206 is approximately 100.

In embodiments, the surface of target 1207 forms an angle 1221 with respect to a horizontal axis 1225 passing through the center of collimating aperture 1208. In other words, an axis line 1225 passing through the center of the collimating aperture 1208 would intersect with the plane defined by the surface of the target 1207 in a manner that forms an angle where the angle has a range from 6 degrees to 50 degrees, preferably 30 degrees. The choice of angle is determined by many factors, including, but not limited to fan beam angle, cone beam angle, spectral quality variation across the beam, and effective focal spot size. It should be noted that a horizontal axis line through the center of the collimating aperture is chosen to provide reference however, the embodiments of the present specification may also be described with reference to a vertical axis line through the center of the electron aperture.

In one embodiment, an axis line 1220 passing through the center of the electron aperture 1206 would intersect with the axis line 1225 passing through the center of the collimating aperture 1208 in a manner that forms an angle where the angle has a range from 70 degrees to 110 degrees, preferably 90 degrees 1222.

Optionally, the graphite layer on wall 1202 extends through to block the X-ray beam exit path, but does not block the electron beam path from the electron gun to the target. The solid angle subtended by the graphite lined region is as large as possible to the electrons backscattered from the target. In order to maximize solid angle, the graphite region is as close to the target region as possible while far away enough to avoid the main electron beam. Thus, in an embodiment, the graphite region is approximately 1 mm away from the region of the target that is directly irradiated by the electronics. It should be noted herein that target surface 1207 does not have a graphite lining.

In an embodiment, each anode comprises one collimated electron aperture per electron gun. Therefore in systems where only a single electron gun is employed, only one electron and collimating aperture exists. In multi-focus systems, such as that described in U.S. patent application Ser. No. 14/588,732, herein incorporated by reference in its entirety, there may be hundreds of apertures.

The above examples are merely illustrative of the many applications of the system of present specification. Although only a few embodiments of the present specification have been described herein, it should be understood that the present specification might be embodied in many other specific forms without departing from the spirit or scope of the specification. Therefore, the present examples and embodiments are to be considered as illustrative and not restrictive, and the specification may be modified within the scope of the appended claims.

We claim:

1. An anode for an X-ray tube having at least two channels, the anode comprising:

a first channel extending through the anode, wherein the first channel comprises:

a first target defined by a first plane;

a first electron aperture, comprising a first material, through which electrons from a first source of electrons pass to strike said first target, wherein said first electron aperture comprises side walls, each of said side walls having a surface, and a central axis and wherein each of the side walls face each other and define a first pathway through which the electrons travel; and a first collimating aperture through which X-rays produced at the first target pass out of the anode as a first collimated beam, wherein said first collimating aperture comprises side walls, each of said side walls having a surface, and a central axis;

a second channel extending through the anode, wherein the second channel comprises:

a second target defined by a second plane;

a second electron aperture through which electrons from a second source of electrons pass to strike the second target, wherein the second electron aperture comprises side walls, each of said side walls having a surface, and a central axis and wherein each of the side walls face each other and define a second pathway through which the electrons travel; and a second collimating aperture through which X-rays produced at the second target pass out of the anode as a second collimated beam, wherein the second collimating aperture comprises side walls, each of said side walls having a surface, and a central axis, wherein the first electron aperture is separate from the second electron aperture and the first collimating aperture is separate from the second collimating aperture.

2. The anode of claim 1, wherein at least a portion of the surfaces of the side walls of the first electron aperture and the second electron aperture are lined with an electron absorbing material and wherein the electron absorbing material is different from the first material, and wherein the electron absorbing material is adapted to absorb any electrons straying from a predefined trajectory.

3. The anode of claim 2 wherein the electron absorbing material has a low atomic number.

4. The anode of claim 2 wherein the electron absorbing material has a high melting point.

5. The anode of claim 2 wherein the electron absorbing material is stable in a vacuum.

6. The anode of claim 2 wherein the electron absorbing material is graphite.

7. The anode of claim 6 wherein a thickness of the graphite is 0.1 to 2 mm.

8. The anode of claim 2 wherein the electron absorbing material is boron.

9. The anode of claim 1 wherein a plane of the first target is positioned at an angle relative to a horizontal axis passing through a center of the first collimating aperture.

10. The anode of claim 9 wherein the angle of the plane of the first target relative to a horizontal axis passing through the center of the first collimating aperture ranges from 5 degrees to 60 degrees.

11. The anode of claim 9 wherein the angle of the plane of the first target relative to a horizontal axis passing through the center of the first collimating aperture is 30 degrees.

12. The anode of claim 2 wherein the electron absorbing material on at least a portion of the side walls of the first electron aperture extends through to block an X-ray beam exit path through the first collimating aperture.

13. The anode of claim 12 wherein the electron absorbing material on the side walls of the first electron aperture is approximately 1 mm away from a region of the first target that is directly irradiated by a plurality of electronics.

14. The anode of claim 1 wherein a the plane of the second target and the central axis of the second collimating aperture are adapted to intersect in a manner that forms an angle, wherein said angle is in a range of 10 degrees to 50 degrees.

15. The anode of claim 14 wherein said angle is 30 degrees.

16. The anode of claim 1 wherein the central axis of the first electron aperture and the central axis of the first collimating aperture are adapted to intersect in a manner that forms an angle, wherein said angle is in a range of 70 degrees to 110 degrees.

17. The anode of claim 16 wherein said angle is 90 degrees.

* * * * *